US007883384B1

(12) United States Patent
Williams

(10) Patent No.: US 7,883,384 B1
(45) Date of Patent: Feb. 8, 2011

(54) SELF-CONTAINED HYDRAULIC THRUSTER FOR VESSEL

(76) Inventor: John T. Williams, 215 Avon St., Port Orange, FL (US) 32127

( * ) Notice: Subject to any disclaimer, the term of this patent is extended or adjusted under 35 U.S.C. 154(b) by 10 days.

(21) Appl. No.: 12/381,245

(22) Filed: Mar. 10, 2009

Related U.S. Application Data

(63) Continuation-in-part of application No. 11/999,531, filed on Dec. 6, 2007, now Pat. No. 7,654,875.

(60) Provisional application No. 60/903,400, filed on Feb. 26, 2007.

(51) Int. Cl.
*B63H 21/12* (2006.01)

(52) U.S. Cl. ..... 440/5; 114/151

(58) Field of Classification Search ..... 440/5, 440/6, 61 A, 61 R; 114/150, 151
See application file for complete search history.

(56) References Cited

U.S. PATENT DOCUMENTS 583,740 A 6/1897 Fryer
2,486,049 A 10/1949 Miller
2,766,715 A 10/1956 Waterval
2,936,730 A * 5/1960 Patty, Jr. ..... 440/56
3,010,424 A 11/1961 Peterson et al.
3,139,062 A 6/1964 Keefe
4,358,280 A 11/1982 Jeanson et al.
4,645,463 A 2/1987 Arneson
4,848,702 A 7/1989 Riggins
4,878,864 A 11/1989 Van Bentem
5,249,378 A 10/1993 Frame
5,476,400 A 12/1995 Theophanides
6,234,854 B1 5/2001 Rydzewski
6,375,524 B1 4/2002 Commandeur et al.
6,409,556 B1 6/2002 Vance
6,672,236 B1 1/2004 Pinsof
6,799,528 B1 10/2004 Bekker
6,814,636 B2 11/2004 Nolen
7,163,427 B1 * 1/2007 Lee ..... 440/6
2007/0087638 A1 4/2007 Dulgur

OTHER PUBLICATIONS

OHLA® 200 Overhung Load Adaptors Descriptive Bulletin describing models 210, 210F, 215, 210-10, 210-12, and 215-12. (1 page).

* cited by examiner

*Primary Examiner*—Lars A Olson
(74) *Attorney, Agent, or Firm*—Paul S. Rooy PA

(57) ABSTRACT

A self-contained hydraulic thruster for vessel. The hydraulic thruster incorporates a lower unit housing tiltably attached to a lower unit mounting tube attached to a base, a tube whose upper end is attached through the lower unit housing, and a shaft slidably disposed within the tube. A substantial length of tube extends downwards from the lower unit housing, thus providing support for the shaft. An actuator is disclosed which extends and retracts the shaft relative to the tube. A steering clamp is releasably attached to an end of the shaft which protrudes through the top of the lower unit housing. A steering clamp key traveling in a shaft keyway, or a shaft key in combination with a steering clamp keyway, help maintain constant the angular orientation between the steering clamp and the shaft. A steering gear meshing with a steering assembly, or an actuator driving a tie rod, provide steering.

29 Claims, 20 Drawing Sheets

SELF-CONTAINED HYDRAULIC THRUSTER FOR VESSEL

CLAIM FOR PRIORITY

This utility patent application is a Continuation-In-Part of U.S. utility application Ser. No. 11/999,531 filed Dec. 6, 2007 now U.S. Pat. No. 7,654,875 entitled Self-Contained Hydraulic Thruster for Vessel, which was based upon U.S. provisional patent application Ser. No. 60/903,400 filed Feb. 26, 2007 entitled Self-Contained Hydraulic Thruster for Vessel; and claims the benefit of the earlier filing date of these applications.

BACKGROUND OF THE INVENTION

Field of the Invention

This invention relates to vessel propulsion systems, and in particular to a self-contained hydraulic thruster for vessel.

BACKGROUND OF THE INVENTION

Marine thrusters typically mount on barges and flat boats, and are used as propulsion for these vessels. One type of marine thruster employs a prime mover such as a diesel engine driving a hydraulic pump, together known as a "power pack", and the resultant pressurized hydraulic fluid may be employed to drive a propeller attached to a lower unit.

There are a number of problems associated with currently available marine thrusters. Where a centrally located tiltable lower unit has been retracted and tilted backwards for storage, maintenance, cleaning, etc., the protruding upper end of the lower unit interferes with the helm and helm platform, and prevents full upward tilting of the retracted lower unit. Therefore, it would be desirable to provide a marine thruster which may be retracted and then fully tilted.

Another problem with current designs is the lack of an effective extension and retraction mechanism for lower units. It is important to be able to retract the lower unit so as to be able to more easily tilt the lower unit upwards for maintenance, storage, or transportation. A number of practical problems must be overcome to provide for an effective retraction apparatus. These include maintaining the angular orientation between cooperating telescoping sections (such as the instant shaft and tube) to allow steering, after the lower unit is extended. Another problem is providing for power assist, so as to avoid the greater work of manually extending and retracting the lower unit. Still another extension/retraction problem lies in adequately supporting the lower end of an extended lower unit, given the long resultant length of the lower unit when extended, and the resultant longer moment arm between the lower unit's mounting point at its upper end, and the propeller's location at its lower end.

Another problem with existing designs: the hydraulic fluid reservoir is disposed on the base of the marine thruster, where it is incapable of supplying enough fluid head to self-prime the power pack, and to facilitate hydraulic fluid flow to the hydraulic power pack. Thus, it would be desirable to provide a hydraulic fluid reservoir which is elevated above the level of the power pack.

Still another problem is where a marine thruster's single lower unit propeller does not supply enough power to adequately propel a vessel upon which it is mounted. It would therefore be desirable to provide a marine thruster with more than one lower unit, for increased power.

Other problems with existing designs include insufficient reinforcement at the lower unit tilt actuator attach point on the base, inadequate bearing surface at the lower unit pivot point, and excess steering motor stress.

Existing Designs

FIGS. 1 and 2 are illustrative of the tilt interference problem, and are rear views of a prior art marine thrusters 2. The location of their lower units 4 directly behind their respective helms causes interference between lower unit 4 and the helm when attempting to fully tilt lower unit 38 up when lower unit 38 is fully retractable. This interference prevents lower unit 38 from fully tilting up when it is fully retracted, thus hindering stowing of lower unit 38 for storage, transportation, servicing, or cleaning.

In addition, the mounting of the hydraulic fluid reservoir on the base of this design provides inadequate flow from the hydraulic fluid tank for self-priming and gravitational flow from hydraulic fluid tank to power pack.

SUMMARY OF THE INVENTION

It an object of this invention to provide a self-contained hydraulic thruster for vessel which is capable of extension, and maintaining the angular orientation between its extension components when extended. Design features allowing this object to be achieved include a steering clamp key traveling within a shaft keyway, or in the alternative, a steering clamp keyway sized to slidably admit a shaft key. Benefits associated with reaching this objective include the ability to steer a shaft by means of a steering clamp being actuated by a steering assembly or a steering actuator and tie rod.

It is another object of this invention to provide a self-contained hydraulic thruster for vessel which is easily extended and retracted. Design features allowing this object to be achieved include a lower unit actuator attached at one end to a tube, and at the other to a shaft. Benefits associated with reaching this objective include decreased operator work load, and increased convenience of operation.

It is yet another object of this invention to provide a self-contained hydraulic thruster for vessel which provides adequate support along the length of the lower unit, especially when under full power. Design features allowing this object to be achieved include an extensible shaft traveling within a tube, the length of the tube being a substantial proportion of the shaft length; in the preferred embodiment, the ratio of the length of the tube to the length of the shaft was 0.24-0.32. In addition, an optional lower support is disclosed, attached at one end to a vessel, and at the other to the shaft. Benefits associated with reaching this objective include the ability to farther extend the lower unit to accommodate greater vessel drafts, and reduced stress and consequent longer life, of the thruster components at the upper attach point of the lower unit.

It is still another object of this invention to provide a self-contained hydraulic thruster for vessel whose lower unit can be securely locked into the fully down-tilted position. Design features allowing this object to be achieved include a docking tab bore sized to admit a locking probe, and a pin bore in the locking probe sized to admit a pin. Benefits associated with reaching this objective include greater security that the lower unit will remain tilted down throughout all operating regimes, including all steering angles, and the consequent increased control and safety in operation of a vessel to which the hydraulic thruster for vessel is mounted.

It is another object of the present invention to provide a self-contained hydraulic thruster for vessel whose lower unit (s) may be retracted and tilted up without interference from the helm platform. Design features allowing this object to be accomplished include at least one lower unit mounted at an end of a lower unit mounting tube, the lower unit being laterally offset from a steering platform. Advantages associated with the accomplishment of this object include more efficient lower unit stowing for storage and/or transportation, greater tilt achievable (close to 90 degrees), the ability to tilt the propellers and lower unit completely out of the water for servicing and cleaning, decreased corrosion due to the ability of getting the lower units and propellers completely out of the water when not in use to reduce corrosion, and greater retraction of the lower unit.

It is still another object of this invention to provide a self-contained hydraulic thruster for vessel whose lower units pivot smoothly and easily within respective lower unit bores in lower unit housings. Design features enabling the accomplishment of this object include at least one bushing inside a lower unit bore, and a lower unit bushing bore sized to slidably admit a lower unit. Advantages associated with the realization of this object include easier and smoother steering, and less force required to accomplish same.

It is another object of the present invention to provide a self-contained hydraulic thruster for vessel which is stable and well-supported on a vessel to which it is mounted. Design features allowing this object to be accomplished include a base having at least one base foot attached to a rear side of the base, with a base foot reinforcement plate and base foot center spar in the base foot. Benefits associated with the accomplishment of this object include better support for the self-contained hydraulic thruster for vessel, and greater operator security.

It is still another object of this invention to provide a self-contained hydraulic thruster for vessel whose steering is reliable and long-lived. Design features enabling the accomplishment of this object include a steering motor driving a drive gear through an overhung load adaptor. Advantages associated with the realization of this object include smoother steering function, longer-lived steering motor, and the associated reduced motor maintenance and replacement costs.

It is another object of the present invention to provide a self-contained hydraulic thruster for vessel with an elevated hydraulic fluid reservoir. Design features allowing this object to be accomplished include a hydraulic fluid reservoir mounted on a helm platform which is elevated a substantial height above a base to which a hydraulic power pack is mounted. Benefits associated with the accomplishment of this object include power pack self-priming, and facilitated hydraulic fluid flow from the hydraulic fluid reservoir to the hydraulic power pack.

It is yet another object of this invention to provide a self-contained hydraulic thruster for vessel which is economical to build. Design features allowing this object to be achieved include the use of components made of readily available materials, and commercially available components such as an existing steering motor, overhung load adapter, hydraulic actuator, hydraulic power pack, hydraulic fluid reservoir, lower unit, propeller, steering gear, drive gear, and hydraulic lines. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Twenty sheets of drawings are provided. Sheet one contains FIGS. 1 and 2. Sheet two contains FIG. 3. Sheet three contains FIG. 4. Sheet four contains FIG. 5. Sheet five contains FIGS. 6 and 7. Sheet six contains FIGS. 8, 9 and 10. Sheet seven contains FIG. 11. Sheet eight contains FIG. 12. Sheet nine contains FIG. 13. Sheet ten contains FIG. 14.

Figure 15:
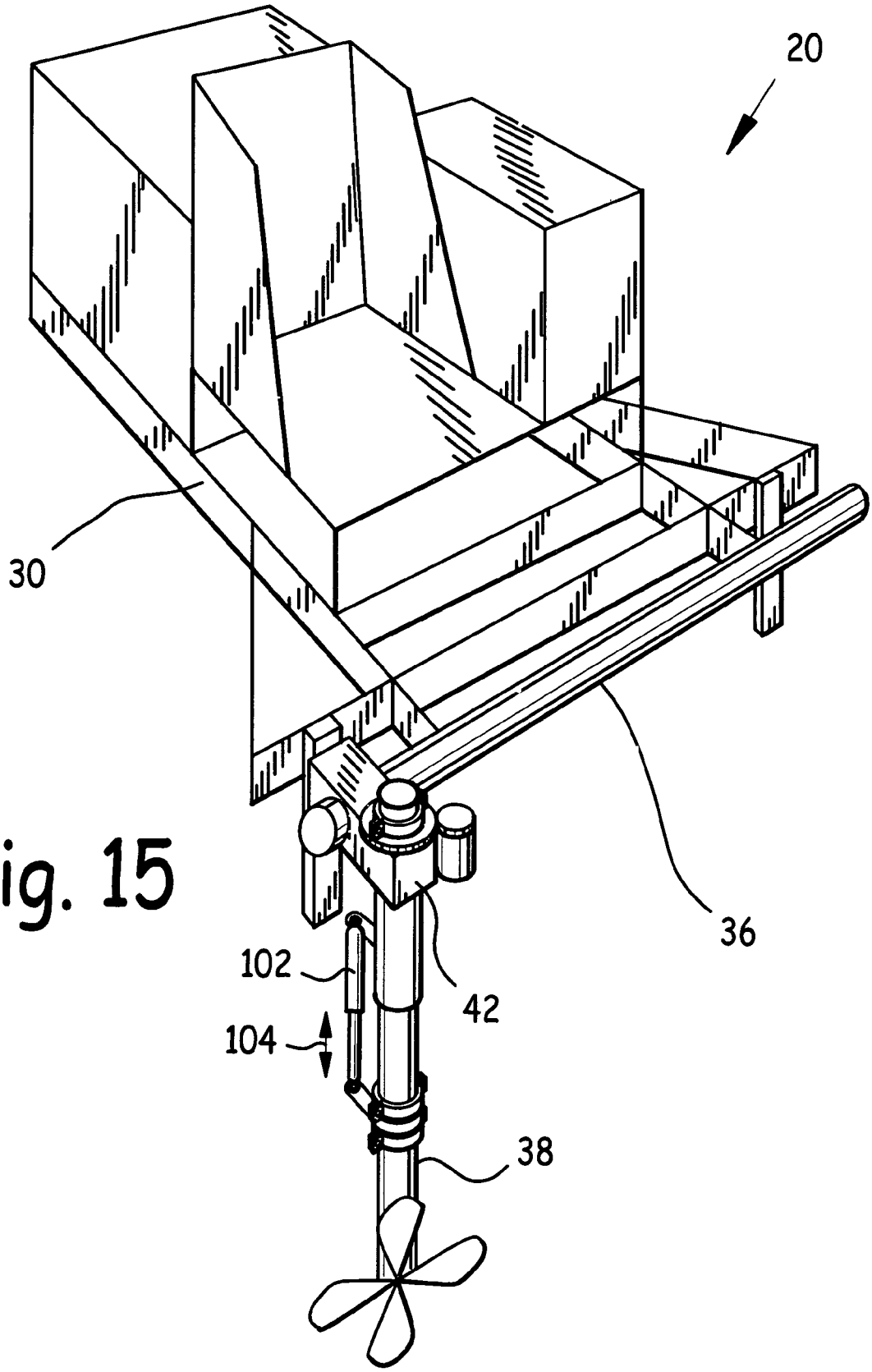

Sheet eleven contains FIG. 15. Sheet twelve contains FIG. 16. Sheet thirteen contains FIG. 17. Sheet fourteen contains FIG. 18. Sheet fifteen contains FIG. 19. Sheet sixteen contains FIG. 20. Sheet seventeen contains FIG. 21. Sheet eighteen contains FIGS. 22 and 23. Sheet nineteen contains FIG. 24. Sheet twenty contains FIGS. 25 and 26.

Figure 1:
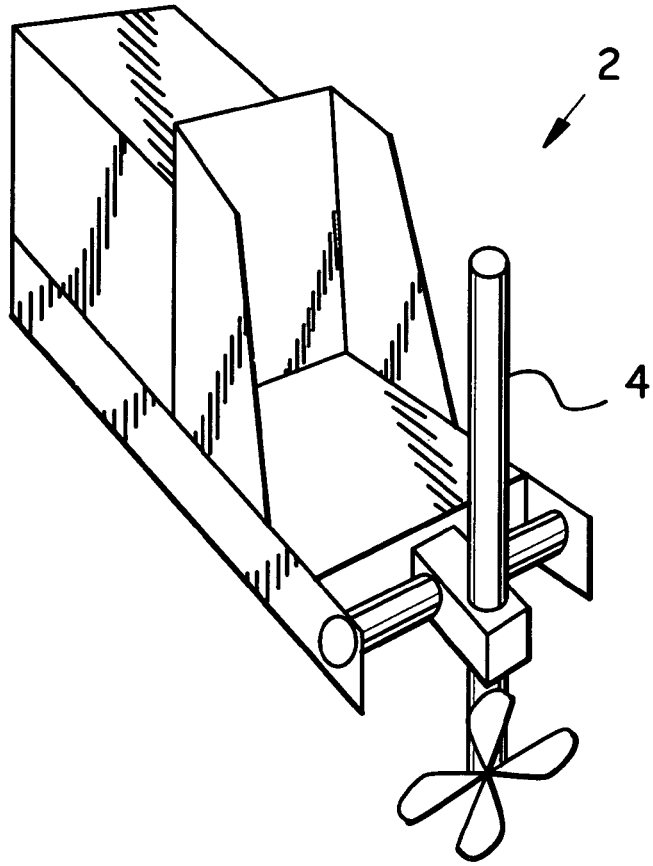
Fig. 1 PRIOR ART
Figure 2:
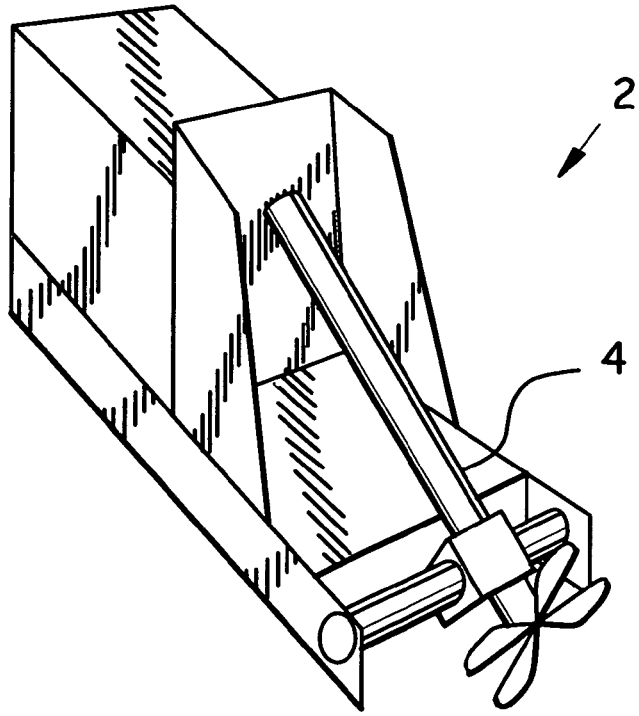
Fig. 2 PRIOR ART

FIGS. 1 and 2 are rear quarter isometric views of a prior art marine thruster.

Figure 3:
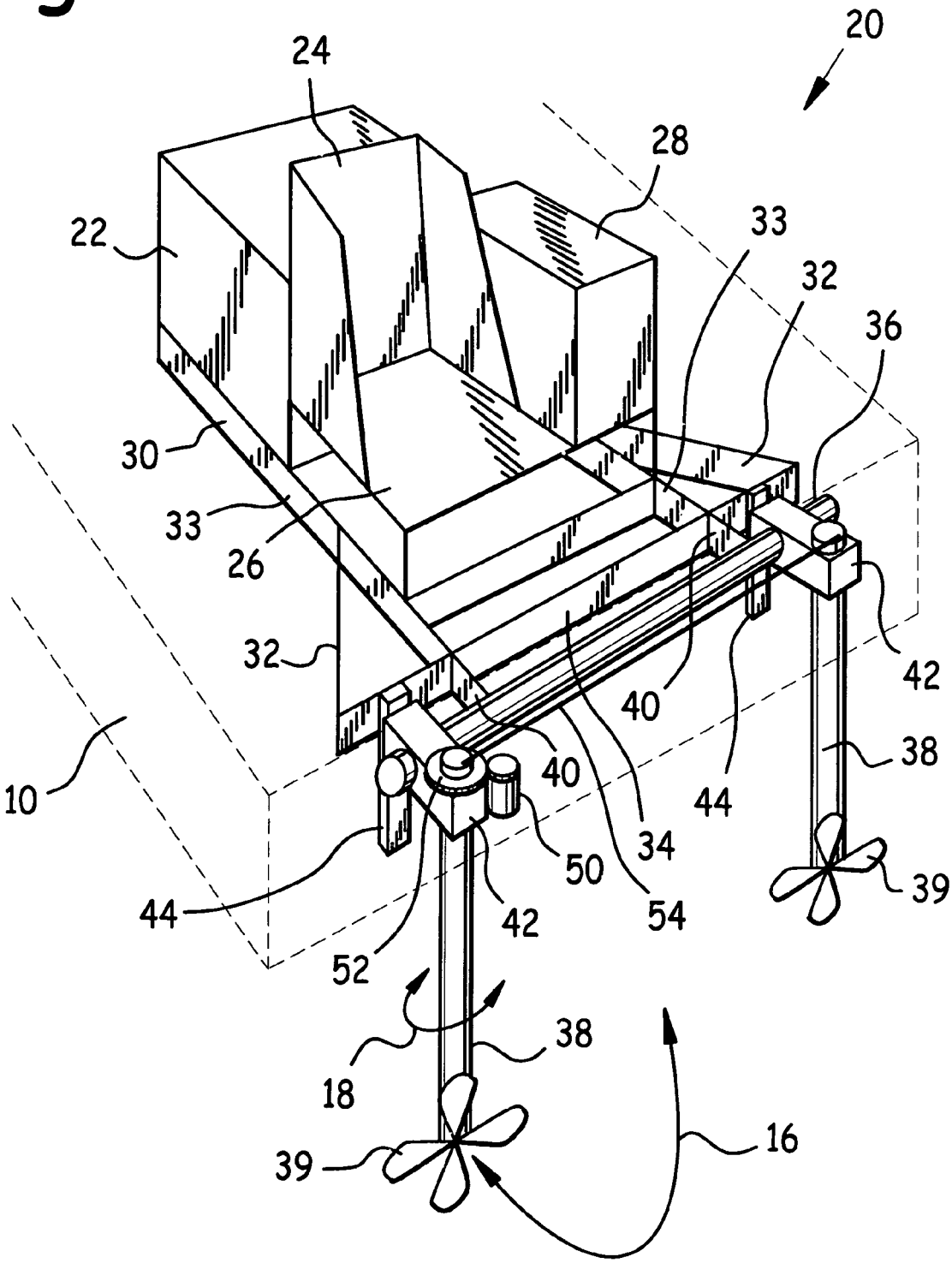

FIG. 3 is a rear quarter isometric view of a self-contained hydraulic thruster for vessel.

Figure 4:
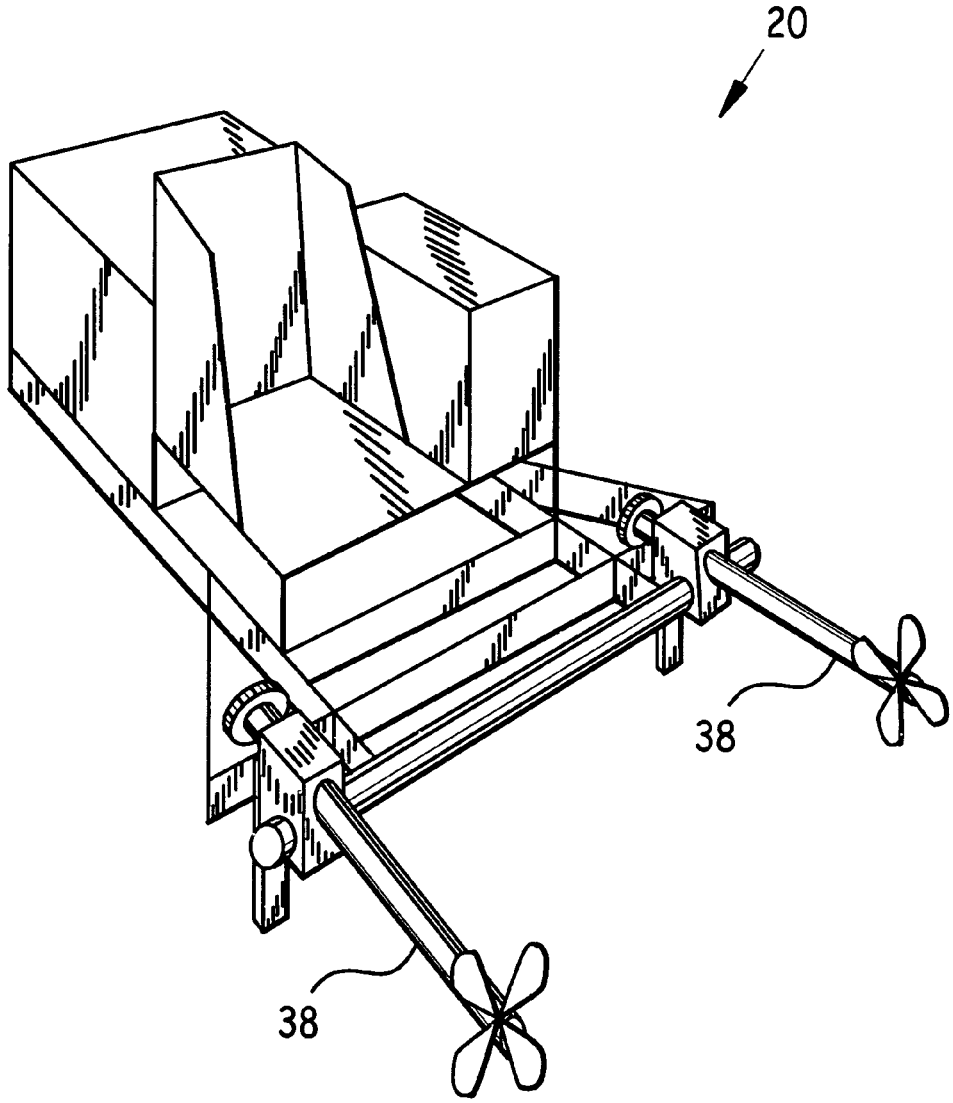

FIG. 4 is a side view of a self-contained hydraulic thruster for vessel with its lower units tilted up.

Figure 5:
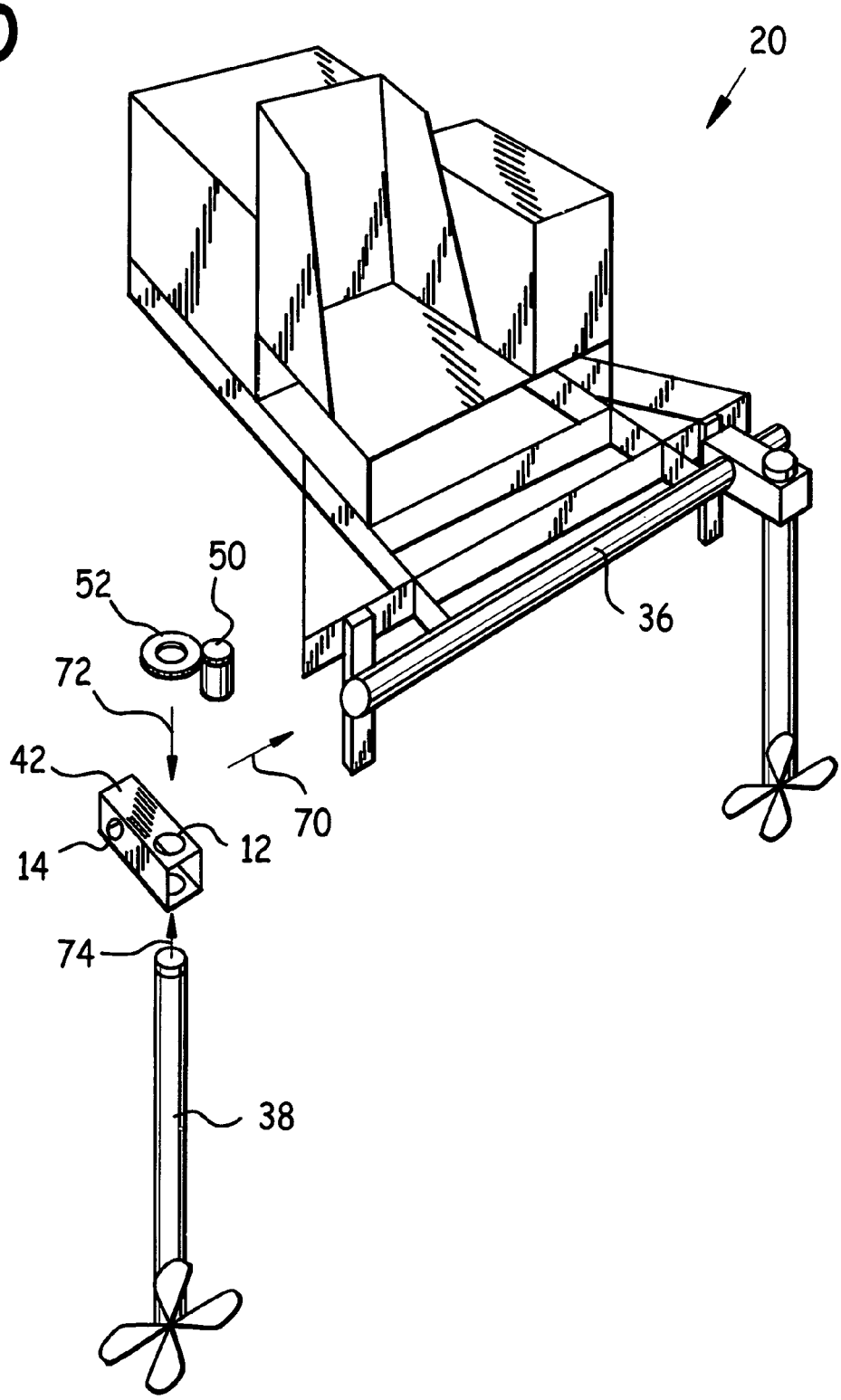

FIG. 5 is a rear quarter isometric view of a self-contained hydraulic thruster for vessel, with its left lower unit housing, left lower unit, steering assembly, and steering gear removed.

Figure 6:
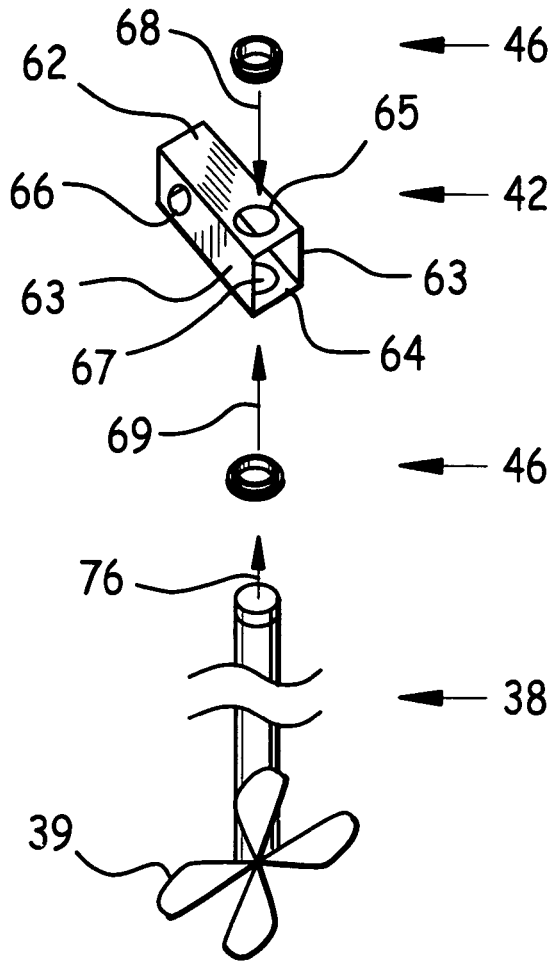

FIG. 6 is an exploded view of a lower unit, lower unit bushings, and lower unit housing.

Figure 7:
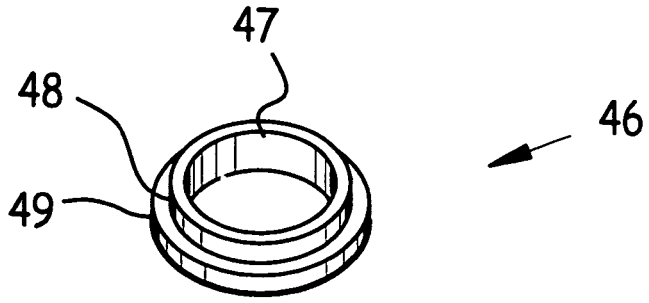

FIG. 7 is a front isometric view of a lower unit bushing.

Figure 8:
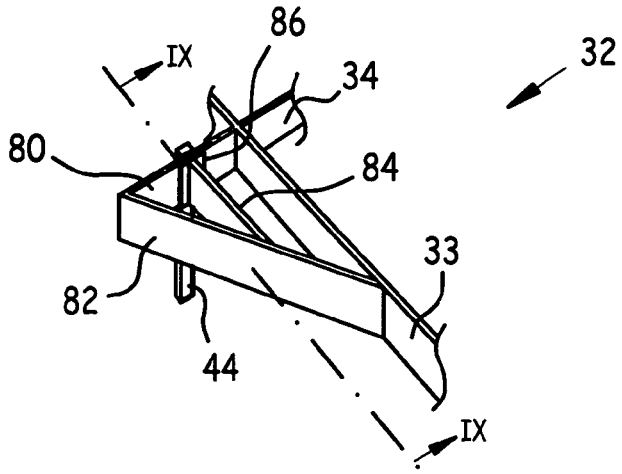

FIG. 8 is a front quarter isometric view of a base foot.

Figure 9:
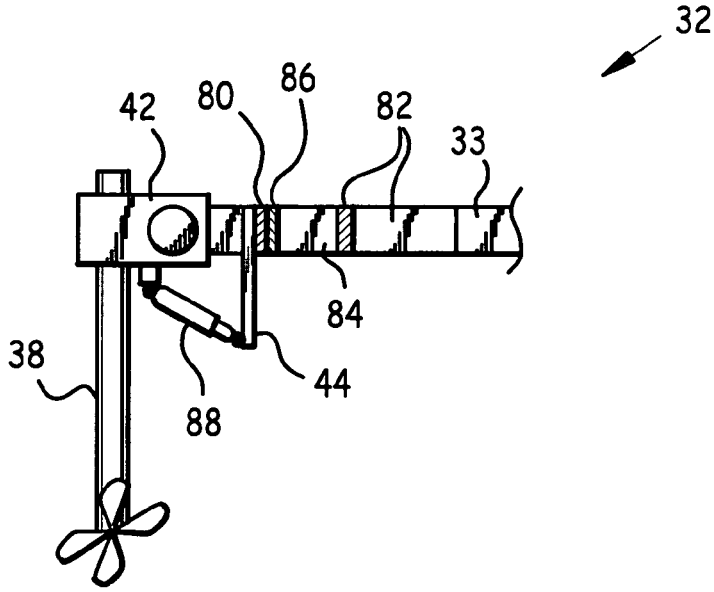

FIG. 9 is a side cross-sectional view of a base foot taken at section IX-IX of FIG. 8, showing the lower unit tilted down.

Figure 10:
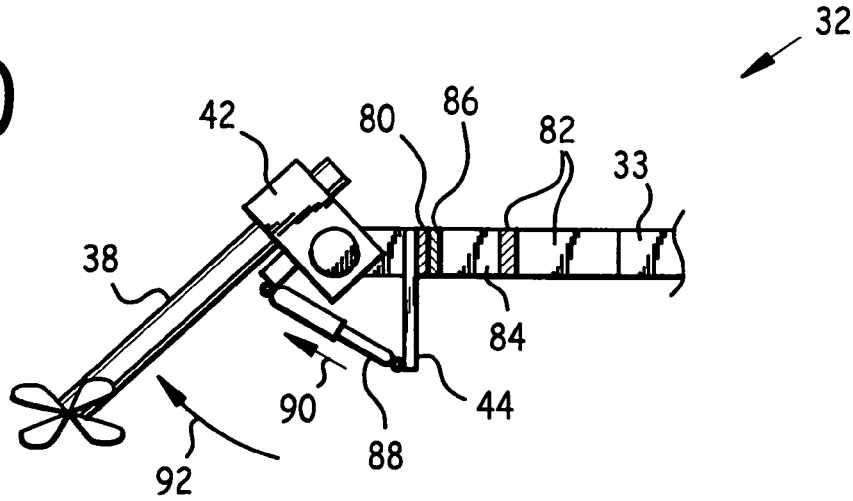

FIG. 10 is a side cross-sectional view of a base foot taken at section IX-IX of FIG. 8, showing the lower unit tilted up.

Figure 11:
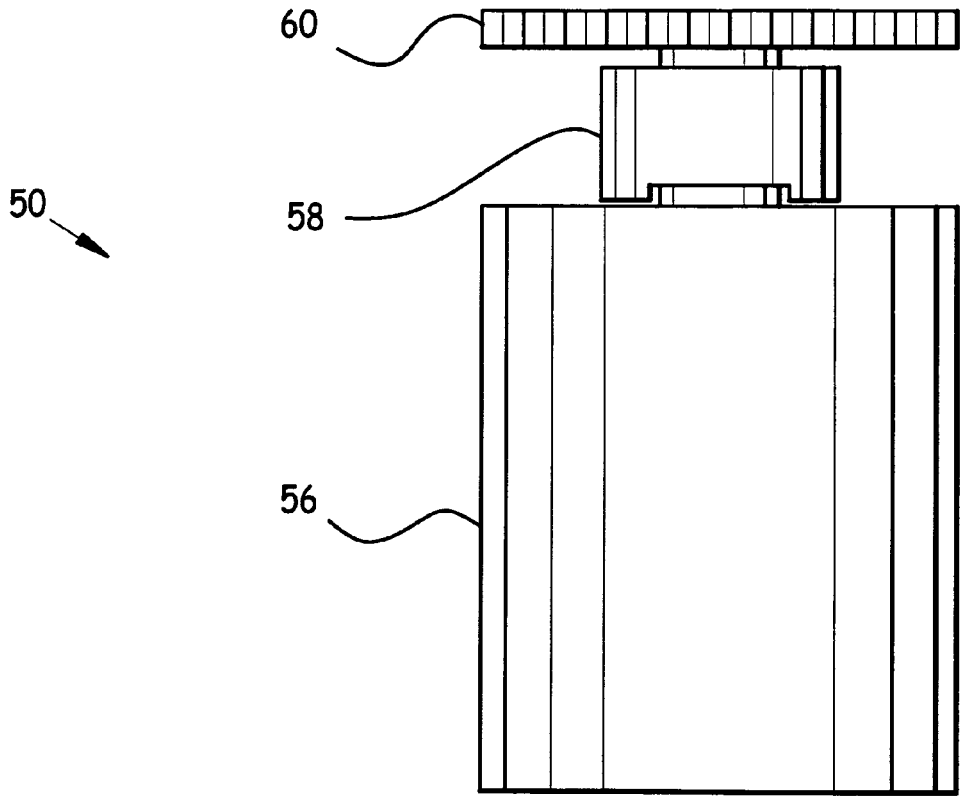

FIG. 11 is a front isometric view of a steering assembly.

Figure 12:
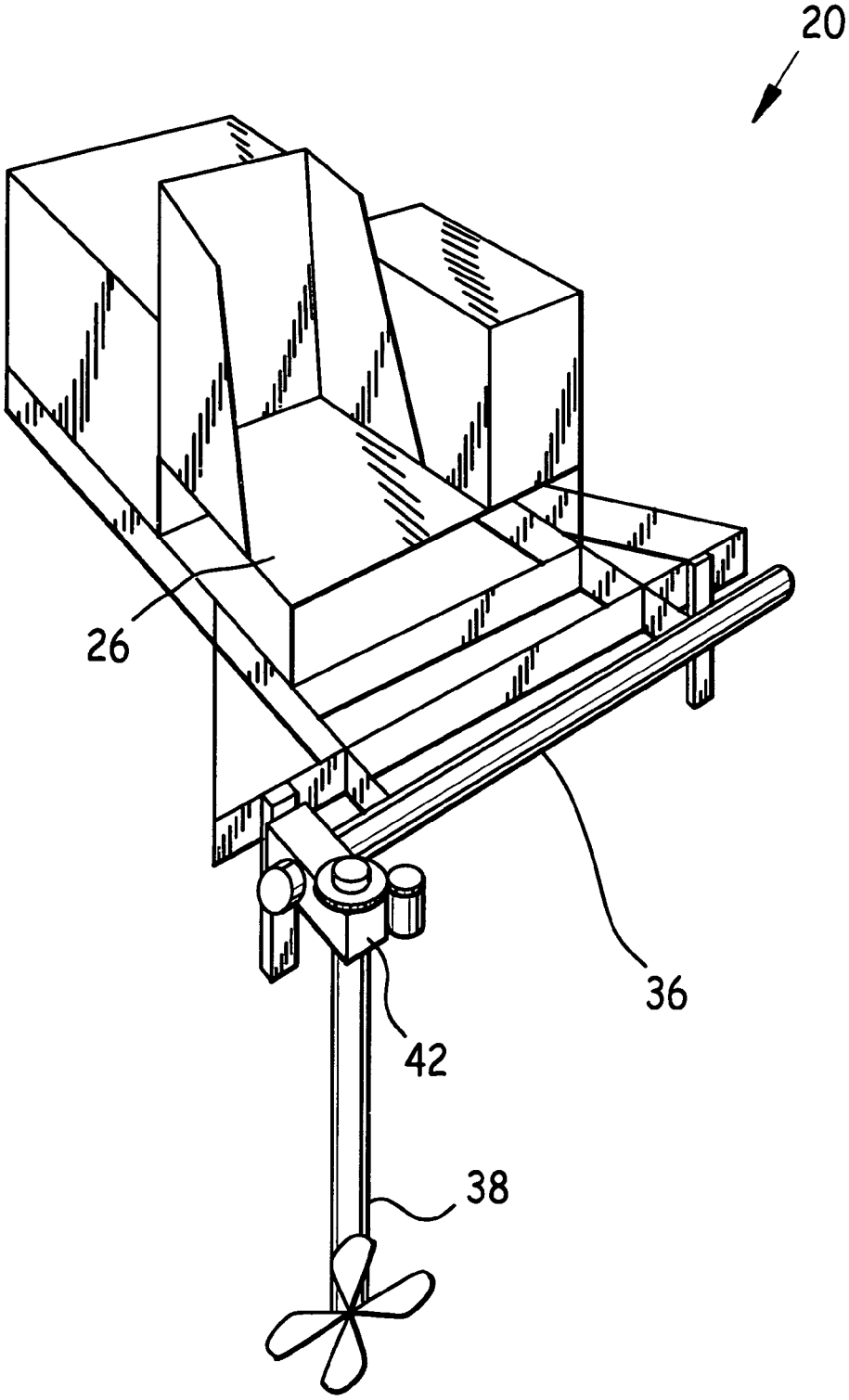
Figure 13:
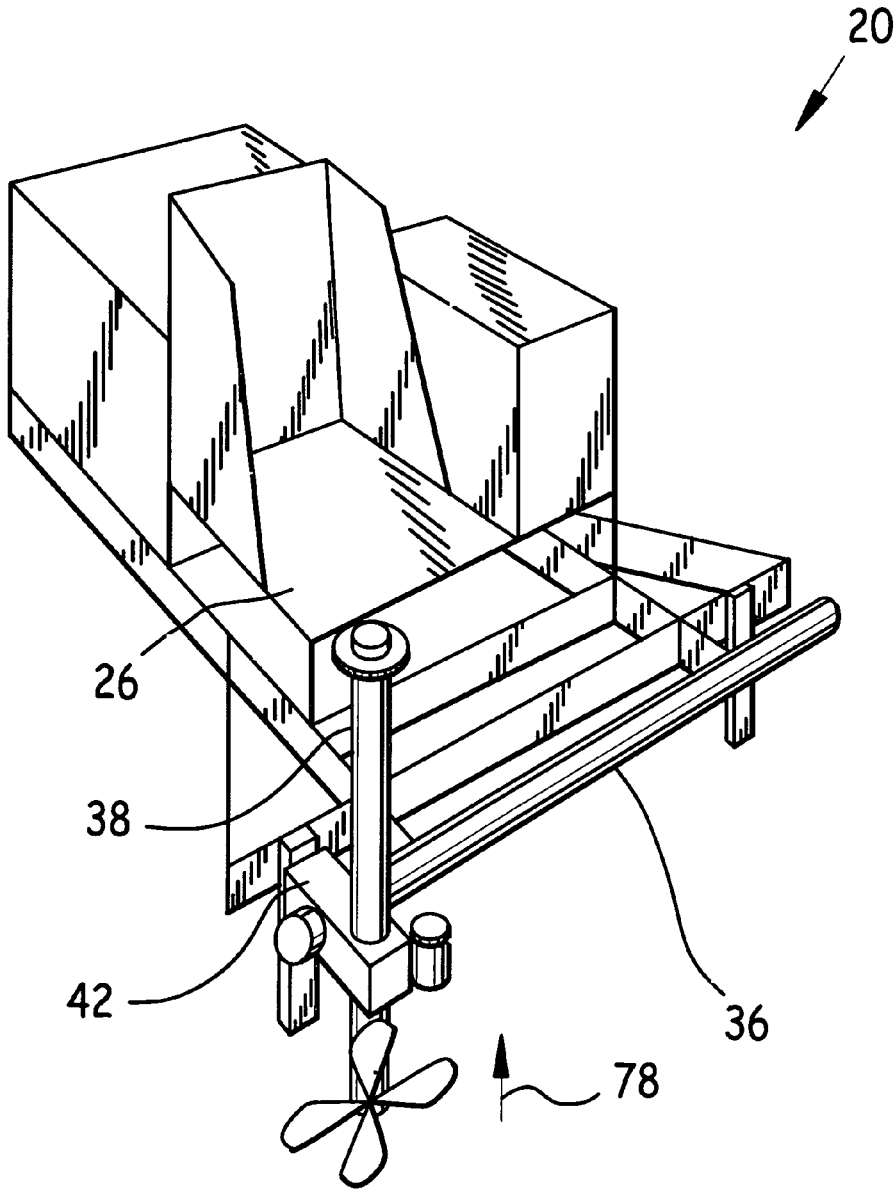
Figure 14:
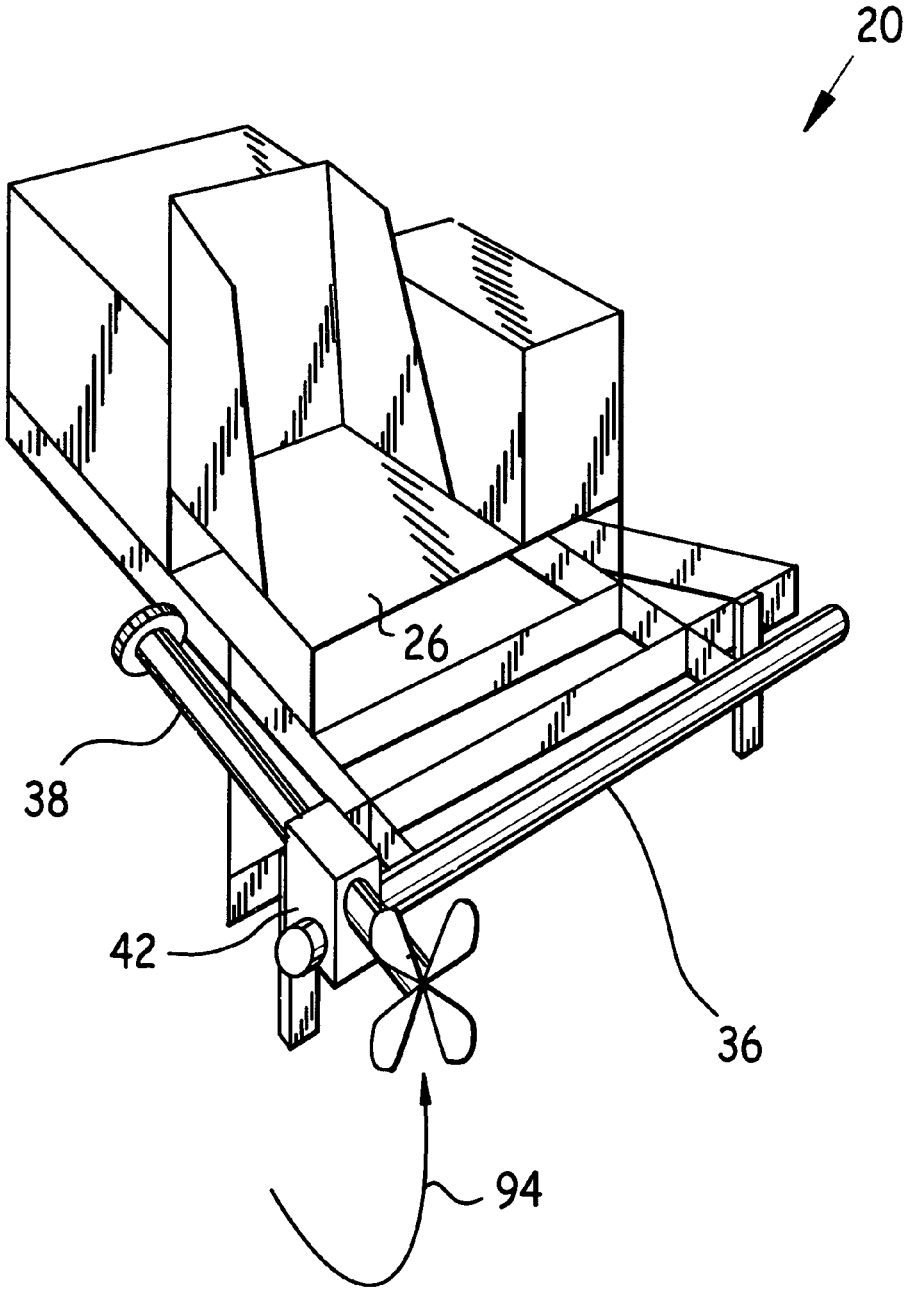

FIGS. 12-14 depict rear quarter isometric views of an alternate embodiment self-contained hydraulic thruster for vessel having a single lower unit 38 offset from the helm platform to permit full retraction and tilting up of the lower unit.

FIG. 15 is a rear quarter elevated isometric view of a hydraulic thruster incorporating a single lower unit having a lower unit actuator for extension and retraction.

Figure 16:
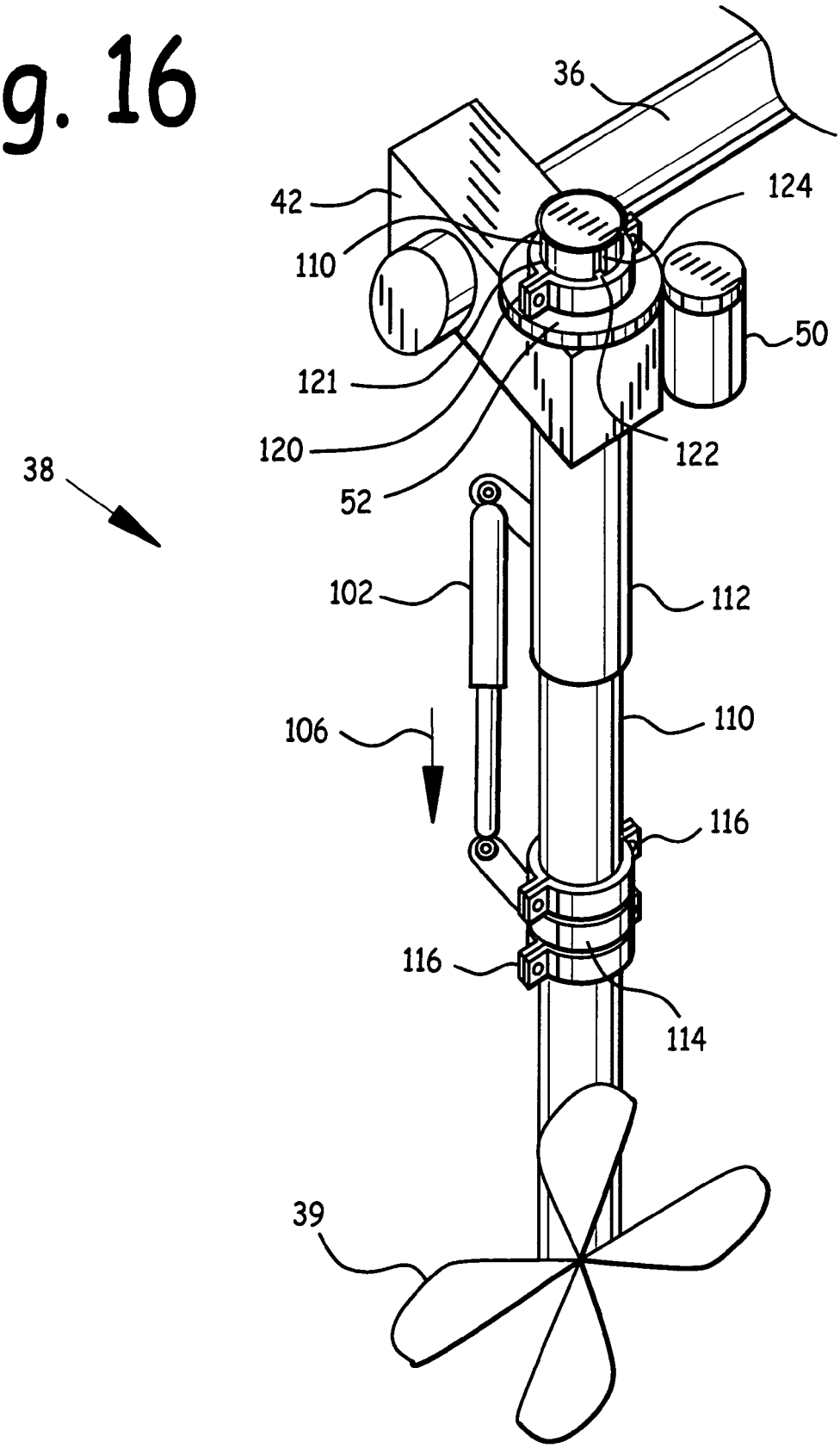

FIG. 16 is a rear quarter elevated isometric view of an extended lower unit having a lower unit actuator for extension and retraction.

Figure 17:
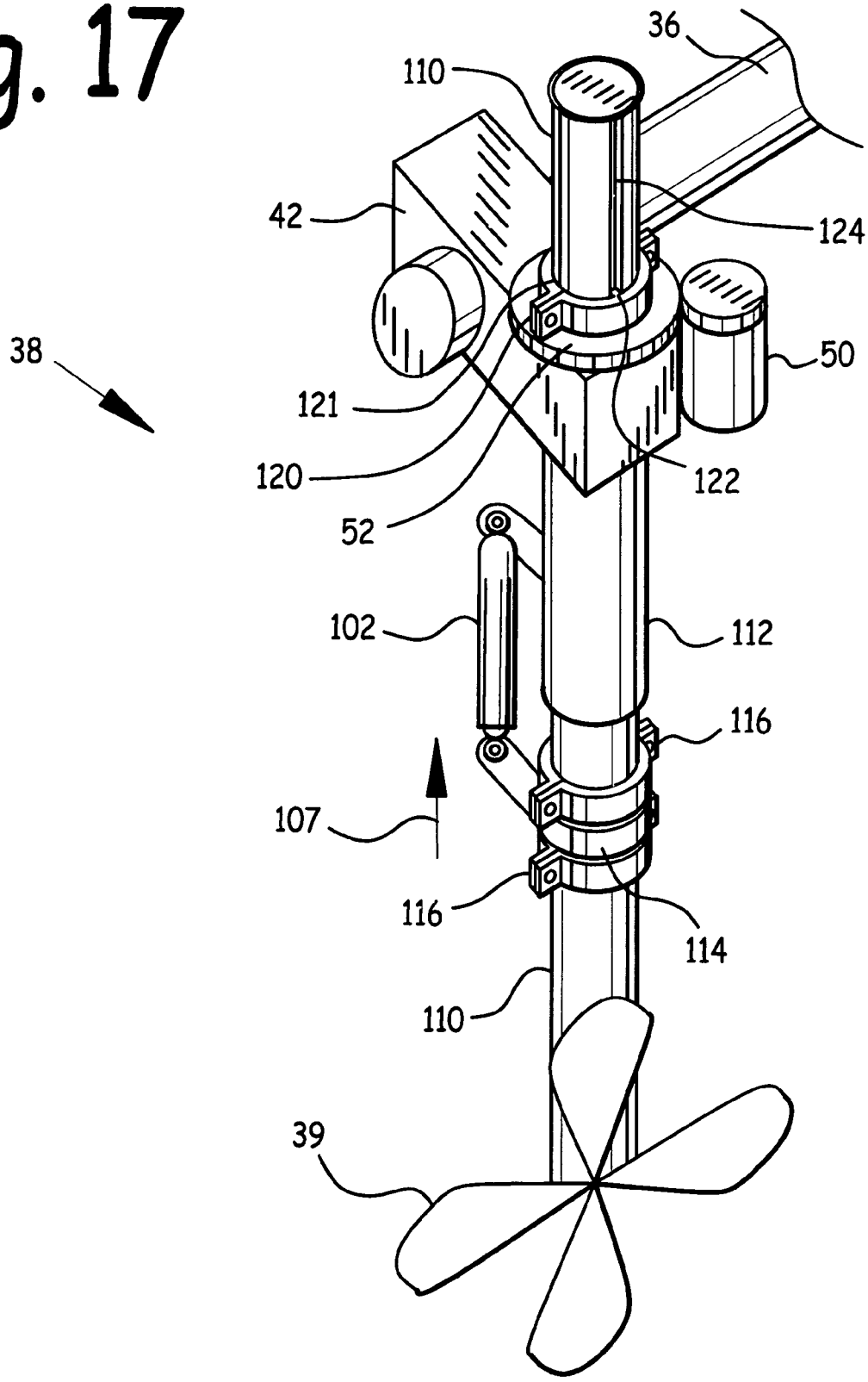

FIG. 17 is a rear quarter elevated isometric view of a retracted lower unit actuator for extension and retraction.

Figure 18:
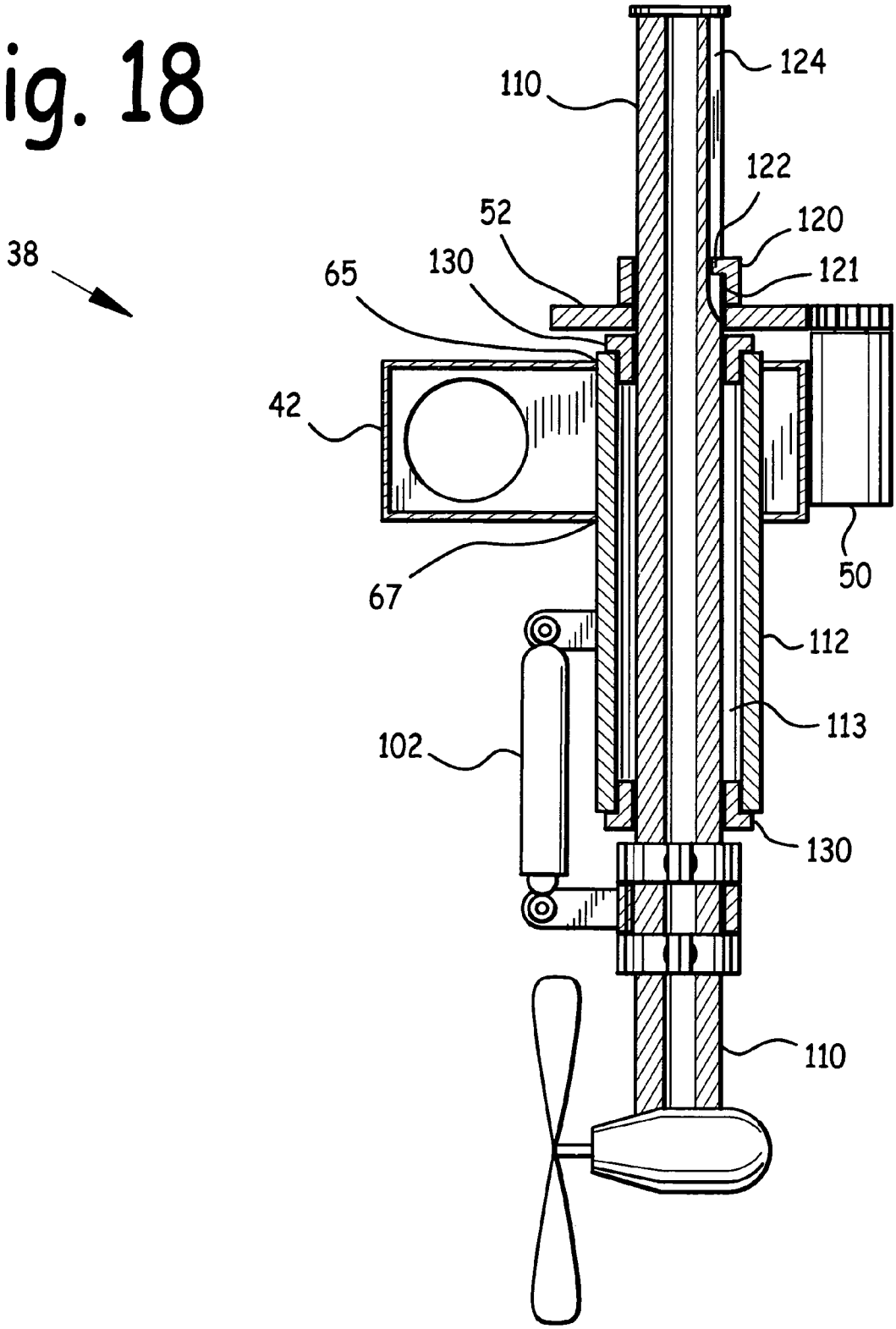

FIG. 18 is a side cross-sectional view of a retracted lower unit having a lower unit actuator for extension and retraction.

Figure 19:
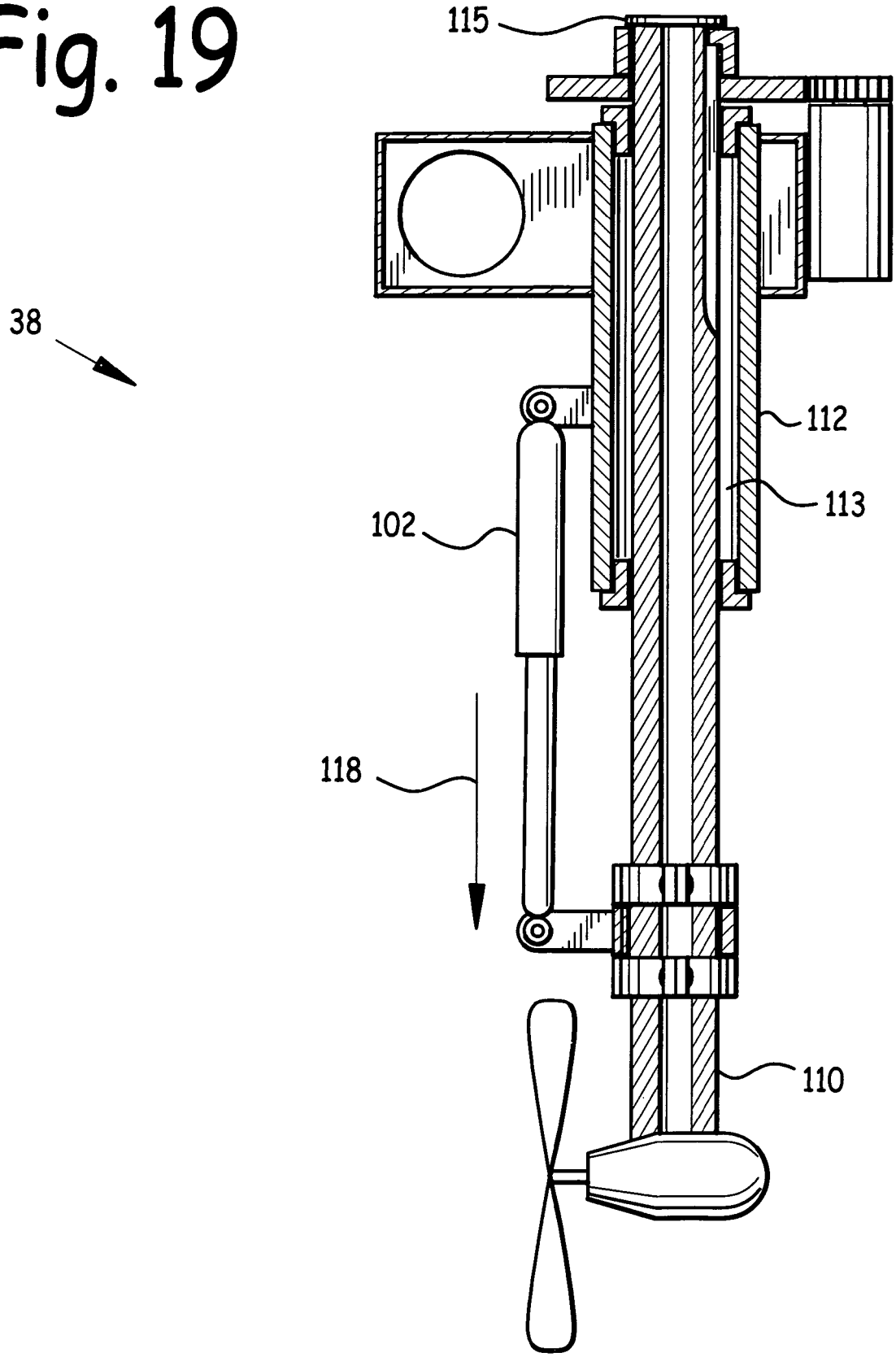

FIG. 19 is a side cross-sectional view of an extended lower unit having a lower unit actuator for extension and retraction.

Figure 20:
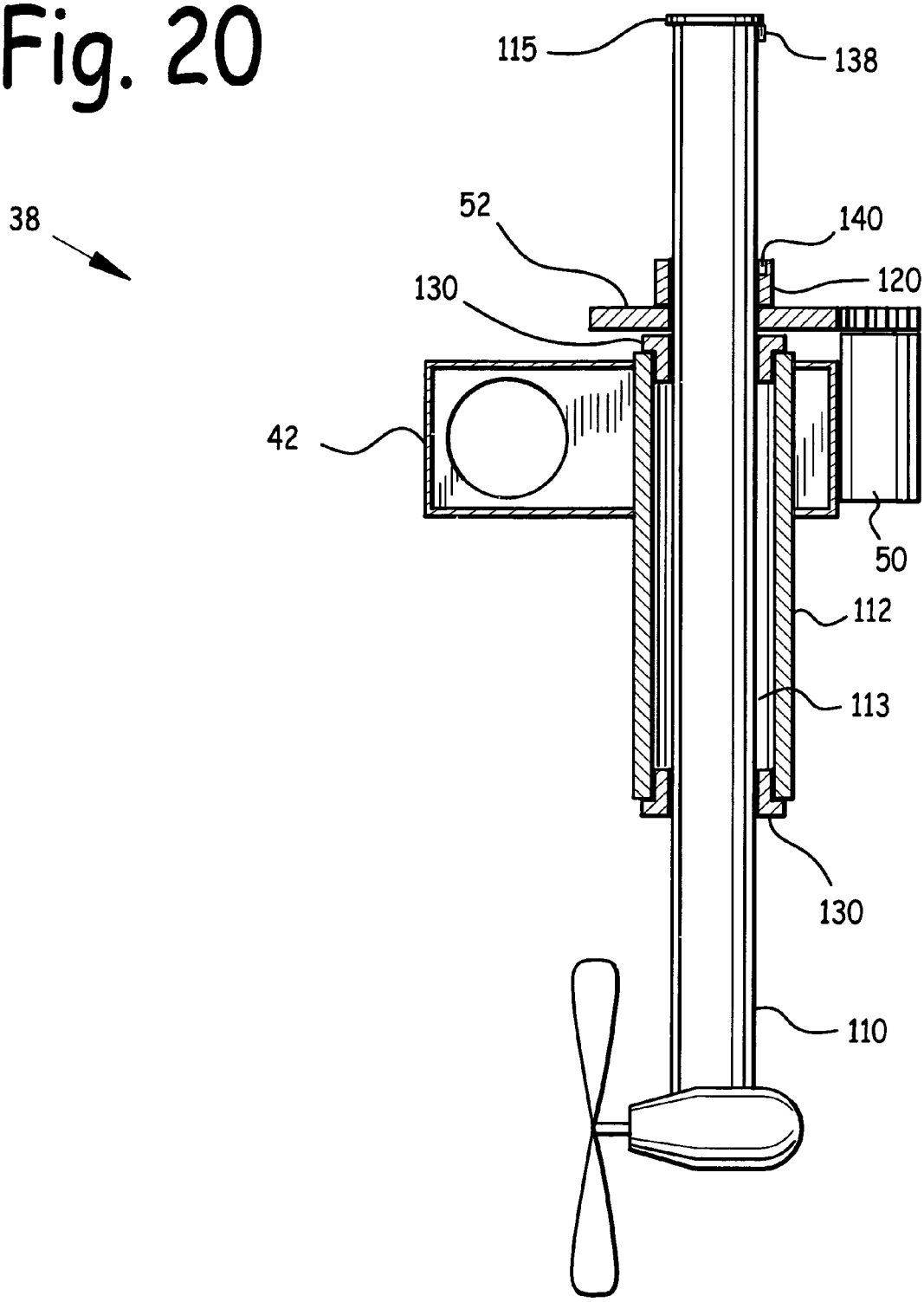

FIG. 20 is a side cross-sectional view of a manually retracted lower unit.

Figure 21:
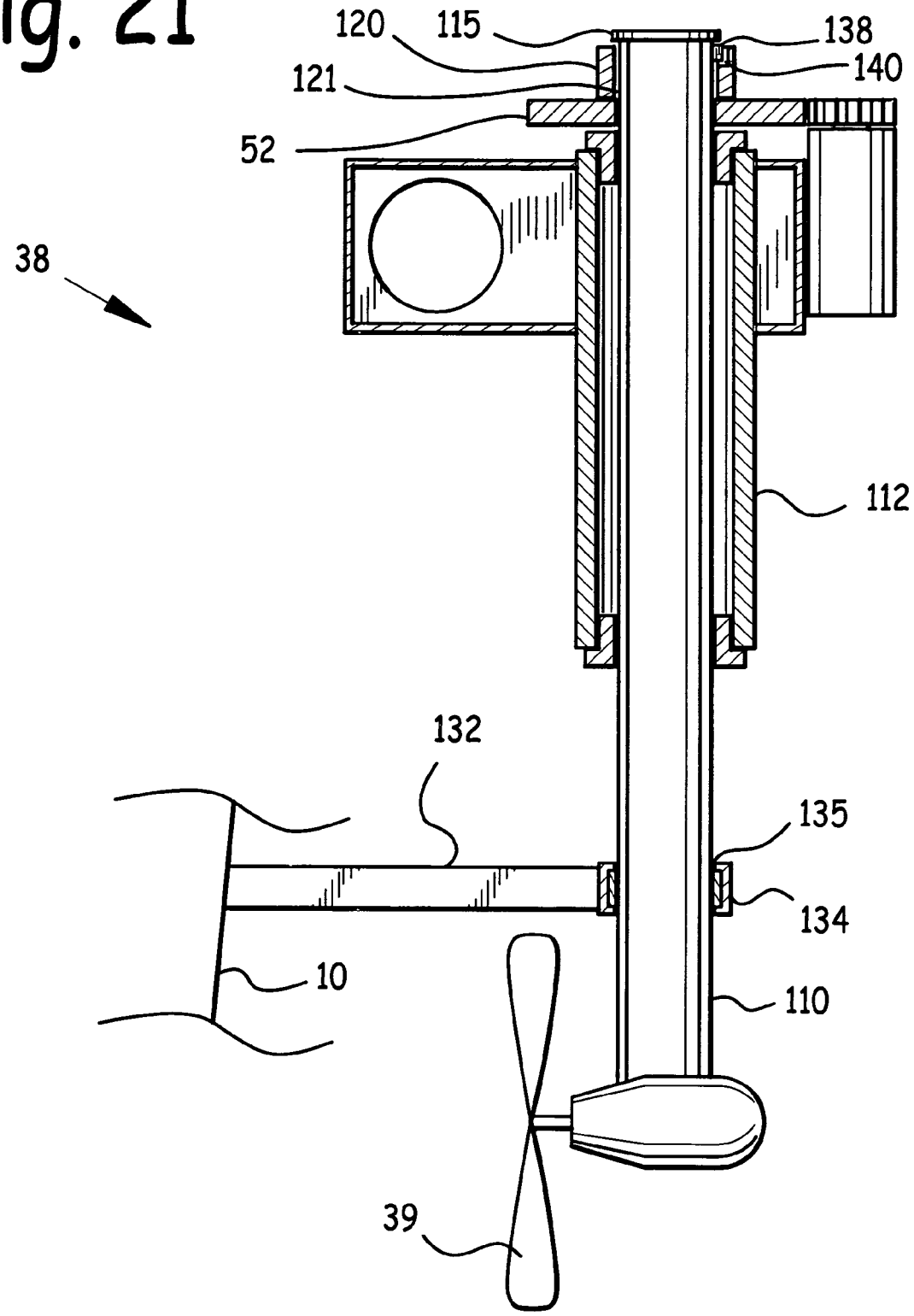

FIG. 21 is a side cross-sectional view of a manually extended lower unit with a lower support.

Figure 22:
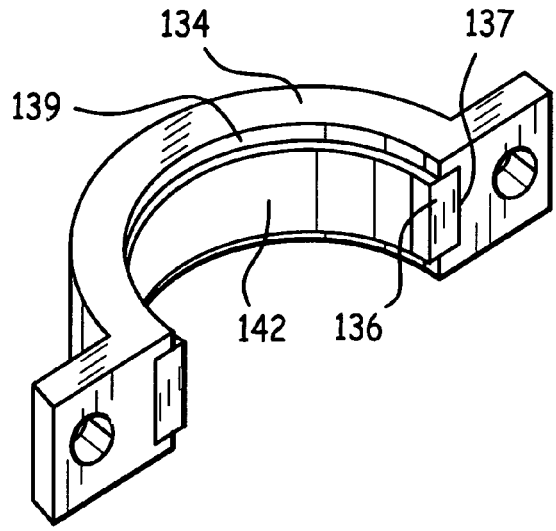

FIG. 22 is an elevated isometric view of half of a lower support collar.

Figure 23:
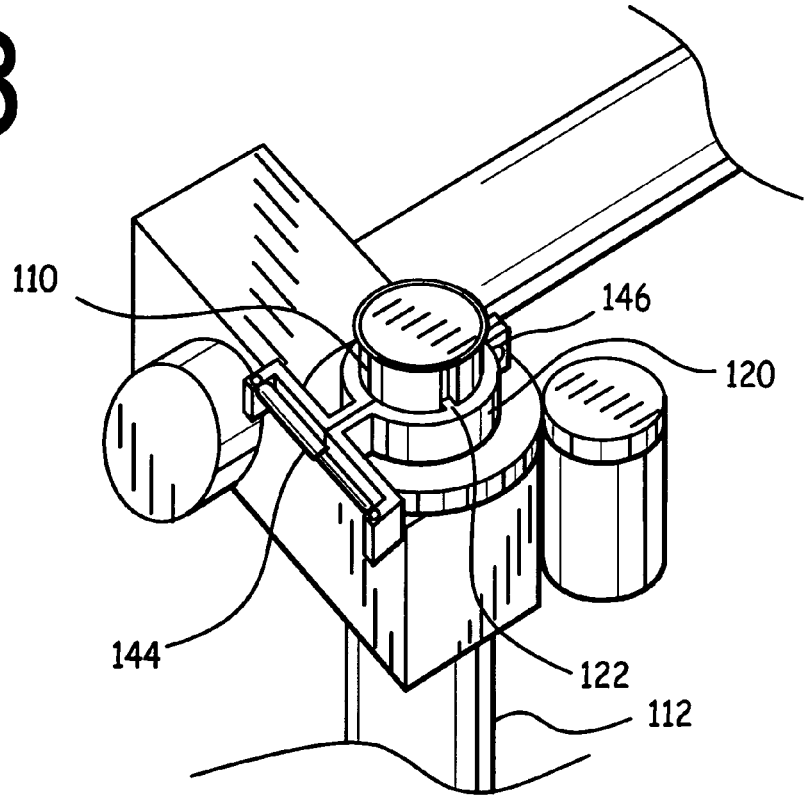
Figure 24:
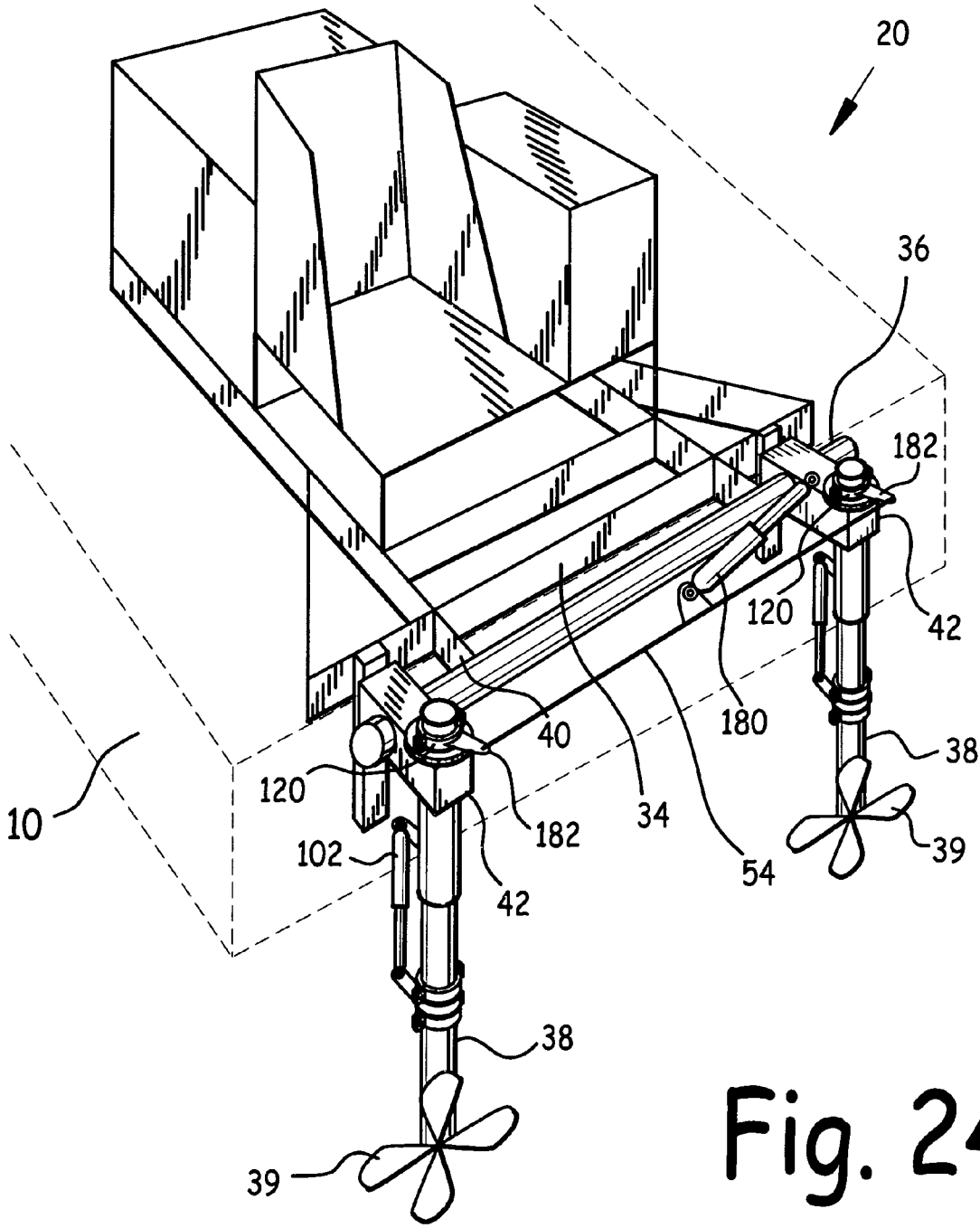

FIG. 23 is a rear quarter elevated isometric view of a steering clamp with a steering clamp actuator FIG. 24 is a rear quarter elevated isometric view of a hydraulic thruster incorporating two lower units steered by a steering actuator.

Figure 25:
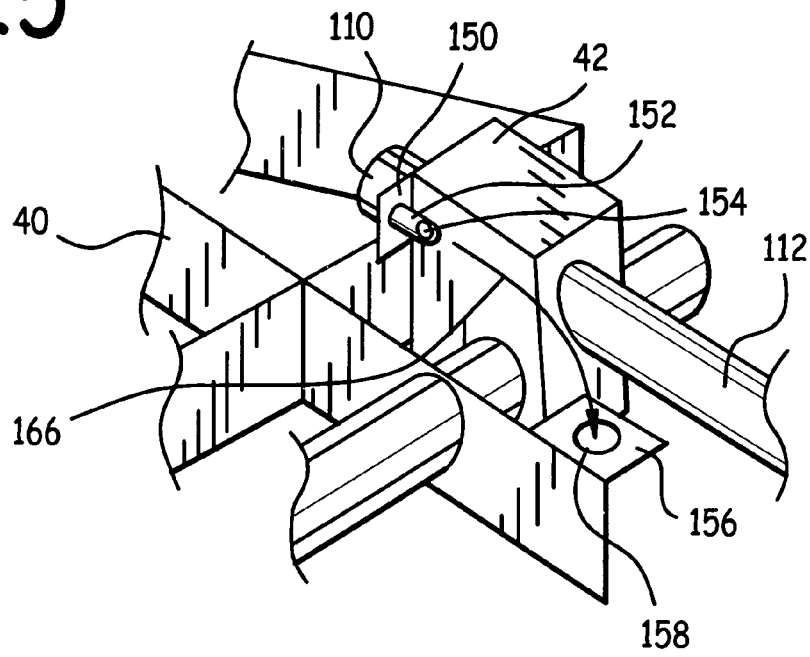

FIG. 25 is a rear quarter elevated isometric view of an up-tilted lower unit housing incorporating a locking probe.

Figure 26:
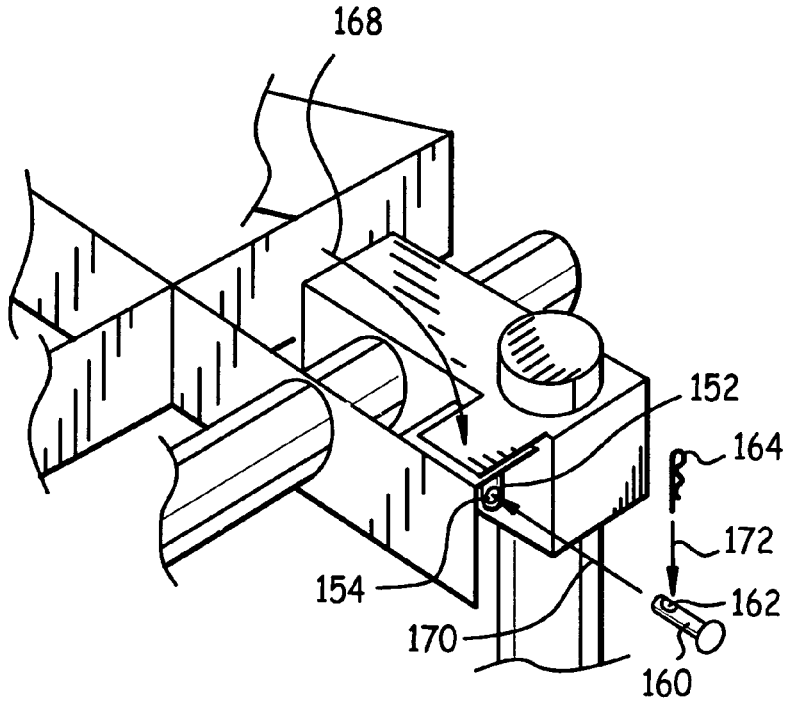

FIG. 26 is a rear quarter elevated isometric view of a down-tilted lower unit housing incorporating a locking probe, ready for a pin to be inserted into its locking probe bore.

DETAILED DESCRIPTION OF THE PREFERRED EMBODIMENT

This disclosure is based upon, and builds on, parent disclosure U.S. utility application Ser. No. 11/999,531 filed Dec. 6, 2007 entitled Self-Contained Hydraulic Thruster for Vessel, which is hereby incorporated by reference into this disclosure. Drawing sheets 1-10 containing FIGS. 1-14, and the passages in this Specification pertaining to these, are substantially the same as in the parent disclosure. Drawing sheets 11-20 containing FIGS. 15-26, and the passages in this Specification pertaining to these, describe the improvements and refinements which are introduced in this disclosure. Accordingly, drawing sheets 1-10 containing FIGS. 1-14 will first be described below, followed by a description of drawing sheets 11-20 containing FIGS. 15-26.

FIG. 3 is a rear quarter isometric view of self-contained hydraulic thruster 20. Hydraulic thruster 20 comprises base 30 which supports hydraulic power pack 22 and helm platform 26. Helm platform 26 in turn supports helm 24 and hydraulic fluid reservoir 28. Helm platform 26 is elevated above base 30 to elevate hydraulic fluid reservoir 28 above the level of hydraulic power pack 22, and for enhanced visibility for the vessel operator.

It is desirable to locate hydraulic fluid reservoir 28 above the level of hydraulic power pack 22 to render the hydraulic system self-priming, and to facilitate the flow of hydraulic fluid from hydraulic fluid reservoir 28 to the hydraulic fluid pump in hydraulic power pack 22. Hydraulic power pack 22 is a conventional, commercially available prime mover, such as a diesel engine, coupled to a hydraulic fluid pump, which supplies hydraulic fluid under pressure to power hydraulic thruster 20.

Base 30 may comprise one or more base feet 32 at its rear, each attached to a base side spar 33, to increase the stability of base 30 on the vessel 10 upon which hydraulic thruster 20 is mounted. One or more vessel stops 44 are mounted to base rear spar 34, and serve to help immobilize hydraulic thruster 20 atop a vessel 10 to which it is mounted, and also transmit force from propellers 39 to vessel 10.

One or more lower unit mounting tube supports 40 extend aft from base rear spar 34 and support lower unit mounting tube 36. One or more lower units 38 are mounted to lower unit mounting tube 36 by means of respective lower unit housings 42. FIGS. 3-5 depict two lower units 38 mounted to opposite ends of lower unit mounting tube 36 by means of respective lower unit housings 42, laterally offset from helm platform 26 in order to permit full retraction and tilting up of lower units 38 to stow same for storage, transportation, servicing, cleaning, etc.

Each lower unit 38 is free to rotate within its respective lower unit housing 42 as indicated by arrow 18 in FIG. 3. Steering assembly 50 mounted to at least one lower unit housing 42 drives steering gear 52 attached to a lower unit 38. Steering assembly 50 causes steering gear 52 to rotate, which in turn causes an associated lower unit 38 to rotate as indicated by arrow 18 in FIG. 3, thus providing a steering function to hydraulic thruster 20. Tie rod 54 connects lower units 38 together, so that as steering assembly 50 causes one lower unit 38 to rotate, tie rod 54 causes the other lower unit(s) 38 entrained by tie rod 54 to rotate the same way.

Hydraulic fluid under pressure from hydraulic power pack 22 powers propeller(s) 39 on lower unit(s) 38, and may also serve as a power source for steering assembly 50.

Each lower unit housing 42 is free to rotate on lower unit mounting tube 36 as indicated by arrow 16 in FIG. 3. This rotational attachment of lower unit housing 42 on lower unit mounting tube 36 permits lower unit(s) 38 to tilt upwards close to 90 degrees from the down position depicted in FIGS. 3 and 5. FIG. 4 is a side view of a self-contained hydraulic thruster 20 with its lower units 38 tilted up.

FIG. 5 is a rear quarter isometric view of a self-contained hydraulic thruster 20 for vessel, with its left lower unit housing 42, left lower unit 38, steering assembly 50 and steering gear 52 removed. Lower unit housing 42 comprises mounting tube bore 14 sized to slidably admit lower unit mounting tube 36, and lower unit bore 12 sized to slidably admit lower unit 38.

Due to the slidable attachment between mounting tube bore 14 and lower unit mounting tube 36, lower unit 38 is free to rotate on lower unit mounting tube 36 in order to tilt up and down, as indicated by arrow 16 in FIG. 3. Similarly, due to the slidable attachment between lower unit bore 12 and lower unit 38, lower unit 38 is free to pivot within lower unit bore 12 in order to provide a steering function, as indicated by arrow 18 in FIG. 3.

Lower unit housing 42 can be re-mounted on lower unit mounting tube 36 simply by sliding lower unit mounting tube 36 into mounting tube bore 14 as indicated by arrow 70 in FIG. 5.

Lower unit 38 can be re-inserted into lower unit housing 42 by sliding it into lower unit bore 12 as indicated by arrow 74. Steering gear 52 can then be attached to lower unit 38, and steering assembly 50 mounted on lower unit housing 42, as indicated by arrow 72.

FIG. 6 is an exploded view of lower unit housing 42, lower unit bushings 46, and lower unit 38 with propeller 39 attached. Lower unit housing 42 comprises lower unit housing roof 62 with lower unit housing roof bore 65, lower unit housing walls 63, each with a lower unit housing wall bore 66, and lower unit housing floor 64 with lower unit housing floor bore 67. Lower unit housing wall bores 66 are sized to slidably admit lower unit mounting tube 36. Lower unit housing roof bore 65 and lower unit housing floor bore 67 are sized to slidably admit lower unit 38.

An alternate embodiment hydraulic thruster 20 comprises lower unit bushings 46. As may be observed in FIG. 7, a front isometric view of lower unit bushing 46, lower unit bushing 46 comprises lower unit bushing lesser outside diameter 48, lower unit bushing greater outside diameter 49, and lower unit bushing bore 47. Lower unit bushing lesser outside diameter 48 is sized to slidably fit into lower unit housing roof bore 65 or lower unit housing floor bore 67. Lower unit bushing greater outside diameter 49 exceeds the diameter of lower unit housing roof bore 65 and the diameter of lower unit housing floor bore 67. Lower unit bushing bore 47 is sized to slidably admit lower unit 38.

As may be observed in FIG. 6, a lower unit bushing 46 is inserted into lower unit housing roof bore 65 as indicated by arrow 68, and a lower unit bushing 46 is inserted into lower unit housing floor bore 67 as indicated by arrow 69. Then lower unit 38 is inserted through the lower unit bushing bores 47 as indicated by arrow 76. In this embodiment, lower unit 38 turns within lower unit bushing bores 47, thus avoiding direct contact between lower unit 38 and lower unit housing roof bore 65 and lower unit housing floor bore 67.

Lower unit bushings 46 serve to cushion and reduce friction associated with the slidable attachment between lower unit housing 42 and lower unit 38. In the preferred embodiment, lower unit bushings 46 were made of nylon, synthetic, plastic, teflon, stainless steel or other metal or coated material, or other appropriate low-friction, corrosion-resistant material.

FIG. 8 is a front quarter isometric view of base foot 32. As may be observed in FIGS. 3 and 5, a base foot 32 may be disposed on either side of the aft end of base 30. In the preferred embodiment, base 30 incorporated base side spars 33, at whose aft end base feet 32 were attached, although it is intended to fall within this disclosure that base foot 32 may be attached to base 30 at any appropriate location or component of base 30.

Base foot 32 comprises base foot rear spar 80, and base foot side spar 82 attached at one end to base foot rear spar 80, and at the other to base side spar 33. In the preferred embodiment, base foot rear spar 80 was an end of base rear spar 34. Base foot 32 further comprises base foot reinforcement plate 86 attached to base foot rear spar 80 at vessel stop 44, and base foot center spar 84 attached at one end to base foot reinforcement plate 86, and at an opposite end to base foot side spar 82. Base foot reinforcement plate 86 and base foot center spar 84 serve to reinforce the structurally critical attach point of vessel stop 44 to base foot 32. In the preferred embodiment, base 30, base foot rear spar 80, base foot reinforcement plate 86, base foot side spar 82, and base foot center spar 84 were of welded metal construction.

FIG. 9 is a side cross-sectional view of a base foot 32 taken at section IX-IX of FIG. 8, showing lower unit 38 tilted down. FIG. 10 is a side cross-sectional view of base foot 32 taken at section IX-IX of FIG. 8, showing lower unit 38 tilted up. Lower unit 38 is tilted up and down by tilt actuator 88. Tilt actuator 88 is attached at one end to lower unit housing 42, and at its other end to vessel stop 44. In the preferred embodiment, tilt actuator 88 was a hydraulic actuator powered by pressurized hydraulic fluid from hydraulic power pack 22, and controlled from helm 24. Lower unit 38, steering assembly 50, and tilt actuator 88 may be connected to hydraulic power pack 22 by any appropriate means, including hydraulic lines, which are not shown in the figures in interest of clarity.

When tilt actuator 88 is extended or retracted as indicated by arrow 92 in FIG. 10, such movement by tilt actuator 88 causes lower unit 38 to tilt up or down as indicated by arrow 92 in FIG. 10. The installation of lower unit(s) 38 laterally offset from elevated helm platform 26 permits lower unit(s) 38 to be tilted up close to 90 degrees from full down, even when lower unit(s) 38 are fully retracted, as depicted in FIG. 14.

FIG. 11 is a front isometric view of steering assembly 50. Steering assembly 50 comprises drive gear 60 sized to mesh with steering gear 52, and steering motor 56. Drive gear 60 is attached to steering motor 56 through overhung load adaptor 58. Overhung load adaptor 58 is attached to steering motor 56, and serves to transfer rotational motion from the output shaft of steering motor 56 to drive gear 60, while minimizing stress put on the internal bearings of steering motor 56, thus prolonging the life of steering motor 56. In the preferred embodiment, overhung load adaptor 58 was a commercially available overhung load adaptor.

FIGS. 12-14 depict rear quarter isometric views of an alternate embodiment self-contained hydraulic thruster 20 for vessel comprising a single lower unit 38 mounted to a single base foot 32. In this embodiment, a single lower unit 38 is mounted at an end of lower unit mounting tube 36 offset from helm platform 26. The offset mounting of lower unit 38 incorporated into this embodiment is important to stow lower unit 38, for transportation, storage, servicing, and cleaning of hydraulic thruster 20.

Due to the slidable attachment of lower unit 38 and lower unit housing 42, lower unit 38 is not only free to pivot, but can also be retracted as indicated by arrow 78 in FIG. 13. Lower unit 38 can be retracted not only for transportation and storage of hydraulic thruster 20, but also to allow hydraulic thruster 20 to be used in shallow water.

Lower unit(s) 38 may be then stowed for transportation, servicing, cleaning and/or storage by tilting up lower unit 38 as indicated by arrow 94 in FIG. 14. It can be readily appreciated that if lower unit 38 were to be centrally mounted on lower unit mounting tube 38, as is depicted in the prior art marine thrusters of FIGS. 1 and 2, the elevated nature of helm platform 26 would interfere with the tilting up of lower unit 38 for storage and transportation: it would not be possible to fully tilt up lower unit 38 due to interference between the upper part of lower unit 38 and helm platform 26. Thus, the mounting of lower unit 38 at an end of lower unit mounting tube 36 laterally offset from elevated helm platform 26 permits more efficient storage and transportation of hydraulic thruster 20, by permitting lower unit 38 to be fully tilted when it is fully retracted, as depicted in FIG. 14.

When mounted on a vessel 10, the alternate embodiment hydraulic thruster 20 depicted in FIGS. 12-14 is positioned such that lower unit 38 is at the centerline of vessel 10, so as to provide laterally symmetrical thrust, and to avoid a turning tendency due to non-centrally located propulsion. It may be noted that the mounting of lower units 38 at either end of lower unit mounting tube 36 in the embodiment depicted in FIGS. 3 and 5, laterally offset from elevated helm platform 26, also permits these lower units to be completely tilted when retracted, for optimal storage and/or transportation.

In the interest of saving material and cost, a single base foot 32 may be incorporated into the single lower unit hydraulic thruster 20 embodiment depicted in FIGS. 12-14, on the same side as the single lower unit 38. In addition, lower unit mounting tube 36 could extend laterally only to the width of the base side spar 33 on the side of base 30 opposite the single lower unit 38, and the vessel stop 44 on that side could then be attached to base rear spar 34, not base foot 32. This single base foot 32 embodiment is depicted in FIG. 12.

FIG. 15 is a rear quarter elevated isometric view of a hydraulic thruster 20 incorporating a single lower unit 38 tiltably mounted to lower unit mounting tube 36 by means of lower unit housing 42, having a lower unit actuator 102 for extension and retraction. As indicated by arrow 104, extension of lower unit actuator 102 extends lower unit 38; retraction of lower unit actuator 102 retracts lower unit 38.

FIG. 16 is a rear quarter elevated isometric view of an extended lower unit 38 having a lower unit actuator 102 for extension and retraction. In FIG. 16 lower unit 38 has been extended by lower unit actuator 102, as indicated by arrow 106.

In the embodiments lower unit 38 depicted in FIGS. 15-21 and 24, lower unit 28 comprises shaft 110 slidably disposed within tube 112. The upper end of tube 112 is rigidly attached to lower unit housing 42. The substantial length of tube 112 which extends downwards from lower unit housing 42 serves to re-enforce shaft 110 against bending when propeller 39 is producing thrust. This re-enforcement function of tube 112 is especially important when the length of shaft 110 is long, which could be necessitated by the draft of a vessel 10 to which it is attached.

In order to achieve this re-enforcing function, in the preferred embodiment, the overall length of tube 112 depended on the length of shaft 110 to be supported. For example, in the "short reach" model, the length of tube 112 was 24 inches, the length of shaft 110 was 88 inches, and the ratio of the length of tube 112 to the length of shaft 110 was 0.273. In the "long reach" model, the length of tube 112 was 36 inches, the length of shaft 110 was 126 inches, and the ratio of the length of tube 112 to the length of shaft 110 was 0.286. In both cases the height of lower unit housing 42, and therefore the length of tube 112 disposed within lower unit housing 42, was 13 inches.

Thus as a general rule, it was determined experimentally that the optimal ratio of the length of tube 112 to the length of shaft 110 is between 0.24 and 0.32. The weight of steering clamp 120 and steering gear 52 hold shaft 110 down in position, under the influence of gravity.

One end of lower unit actuator 102 is attached to tube 112; the opposite end of lower unit actuator 102 is rotatably attached to shaft 110 at actuator collar 114. Because shaft 110 is free to slidably reciprocate and rotate within tube 112, extension and retraction of lower unit actuator 102 extends and retracts shaft 110 within tube 112.

Actuator collar 114 is rotatably disposed between shaft clamps 116. Shaft clamps 116 are rigidly attached to shaft 110. Sufficient clearance is left between shaft clamps 116 and actuator collar 114 to permit actuator collar 114 to freely rotate on shaft 110 without appreciable frictional interference from shaft clamps 116. In the preferred embodiment, shaft clamps 116 were split-ring clamps, whose symmetrical halves were mutually attached at each end via conventional fasteners such as nuts and bolts.

Steering clamp 120 is releasably clamped to shaft 110 above lower unit housing 42. Steering gear 52 is rigidly attached to steering clamp 120. As explained previously, steering assembly 50 drives steering gear 52. Thus, because steering gear 52 is rigidly attached to steering clamp 120, which in turn is rigidly clamped to shaft 110, steering assembly 50 steers by rotating shaft 110 within tube 112, through steering gear 52 and steering clamp 120.

The angular orientation between shaft 110 and steering clamp 120 is further prevented from changing by means of steering clamp key 122 slidably traveling within shaft keyway 124. Steering clamp 120 comprises steering clamp aperture 121, through which shaft 110 extends. Steering clamp key 122 extends radially into steering clamp aperture 121 from steering clamp 120. Loosening steering clamp 120 permits shaft 110 to slide upwards and downwards within steering clamp aperture 121; tightening steering clamp 120 immobilizes steering clamp 120 on shaft 110.

Steering clamp 120 fulfills two principal functions: first, when tightened it locks into place an extended (or retracted) length of shaft 110, and second, due to its rigid attachment to steering gear 52, it steers shaft 110.

Steering clamp key 122 within shaft keyway 124 also serves to prevent steering clamp 120 from rotating relative to shaft 110, even when steering clamp 120 is loosened (such as when shaft 110 is to be extended or retracted, for example).

Thus, the procedure for extending or retracting shaft 110 relative to tube 112 is: first, loosen steering clamp 120; second, command lower unit actuator 102 to extend or retract shaft 110 as desired, and third, re-tighten steering clamp 120 on shaft 110 to lock the extended length of shaft 110. During extension and retraction of shaft 10, steering clamp key 122 traveling within shaft keyway 124 prevents shaft 110 from rotating relative to steering clamp 120.

FIG. 17 is a rear quarter elevated isometric view of a retracted lower unit 38 having a lower unit actuator 102 for extension and retraction. In FIG. 17 lower unit 38 has been retracted by lower unit actuator 102, as indicated by arrow 107.

FIG. 18 is a side cross-sectional view of a retracted lower unit 38 having a lower unit actuator 102 for extension and retraction. FIG. 19 is a side cross-sectional view of an extended lower unit 38 having a lower unit actuator 102 for extension and retraction.

In FIGS. 18 and 19 we can clearly see tube 112 rigidly attached to lower unit housing 42, and extending through lower unit housing roof bore 65 and lower unit housing floor bore 67. In the preferred embodiment, tube 110 was welded to lower unit housing 42, and tube bushings 130 were installed at each end of tube 112.

Tube bushing 130 is shaped as lower unit bushing 46, as illustrated in FIG. 7. The bore of tube bushing 130 is sized to slidably admit shaft 110; the lesser outside diameter of tube bushing 130 is sized to fit into tube bore 113, and the greater outside diameter of tube bushing 130 is sized to not fit into tube bore 113. When a tube bushing 130 is installed at each end of tube 112, shaft 110 can smoothly ride on tube bushings 130, without making direct contact with tube 112.

Above lower unit housing 42, steering clamp 120 is visible rigidly attached to steering gear 52. Steering clamp key 122 extends radially inward from steering clamp aperture 121, and travels within shaft keyway 124:

FIG. 19 depicts shaft 110 extended relative to tube 112, as indicated by arrow 118. Shaft 110 is prevented from overly extending by shaft lip 115, whose diameter exceeds that of tube bore 113.

FIG. 20 is a side cross-sectional view of a manually retracted lower unit 38. As in the embodiments of FIGS. 15-19, the manually retracted lower unit 38 embodiment includes shaft 110 riding on a tube bushings 130 disposed in each end of tube bore 113. The upper end of tube 112 is rigidly attached to lower unit housing 42, and extends downwards through lower unit housing roof bore 65 and lower unit housing floor bore 67.

The embodiment lower unit 38 depicted in FIGS. 20 and 21 is extended or retracted by first loosening steering clamp 120, then manually setting shaft 110 at the desired height relative to tube 112, and then re-tightening steering clamp 120. This has been accomplished in FIG. 20, and shaft 110 is shown retracted upwards. The weight of steering clamp 120 and steering gear 52 hold shaft 110 down in position, under the influence of gravity.

FIG. 21 is a side cross-sectional view of a manually extended lower unit 38 with a lower support 132. Shaft 110 has been extended by first loosening steering clamp 120, then manually extending shaft 110 to the fully extended position depicted in FIG. 21, and then re-tightening steering clamp 120. The weight of steering clamp 120 and steering gear 52 hold shaft 110 down in position, under the influence of gravity.

In the manually extendable embodiment of lower unit 38 illustrated in FIGS. 20 and 21, shaft 110 incorporates shaft key 138 extending radially outward from shaft 110, and steering clamp 120 incorporates steering clamp keyway 140 communicating with steering clamp aperture 121, and extending radially outwards into steering clamp 120 from steering clamp aperture 121. Steering clamp keyway 140 is sized to slidably admit shaft key 138. Shaft key 138 is disposed at an upper end of shaft 110, immediately below and adjacent shaft lip 115. Steering clamp keyway 140 is disposed at an upper end of steering clamp 120.

As depicted in FIG. 21, when shaft 110 is fully extended relative to tube 112, shaft key 138 is slidably disposed within steering clamp keyway 140. In this configuration, shaft key 138 within steering clamp keyway 140 helps maintain the angular orientation of shaft 110 relative to steering clamp 120, and to steering gear 52 (which is rigidly attached to steering clamp 120). The function of shaft key 138 within steering clamp keyway 140 is similar to the function of steering clamp key 122 within shaft keyway 124, described above.

Note that shaft key 138 slides into steering clamp keyway 140 only at the very end of the extension travel of shaft 110. Therefore, it may be necessary to manually align shaft key 138 with steering clamp keyway 140 visually, by rotating shaft 110 relative to steering clamp 120, in order to be able to slide shaft key 138 into steering clamp keyway 140. This alignment can be easily accomplished visually.

The lower unit 38 embodiment depicted in FIG. 21 incorporates lower support 132 rigidly attached to, and extending rearwards from, vessel 10. Especially in the "long reach" embodiment of the instant invention, it is desirable to support the lower extreme of shaft 110. This is accomplished by lower support 132. Lower support collar 134 is rigidly attached to an end of lower support 132 opposite vessel 10.

Referring now also to FIG. 22, an elevated isometric view of half of lower support collar 134, we observe that lower support collar 134 incorporates lower support collar aperture 135 bounded by lower support collar inner face 139, and lower support collar inner face groove 137 in lower support collar inner face 139, extending circumferentially around lower support collar inner face 139.

Lower support collar 134 further comprises lower support collar insert 136 sized to fit into lower support collar inner face groove 137. Lower support collar insert 136 comprises lower support collar insert aperture 142 sized to slidably admit shaft 110. Both lower support collar 134 and lower support collar insert 136 are split-ring design, that is, they are each comprised of two symmetrical halves. Both split-ring halves of lower support collar 134 and lower support collar insert 136 can be assembled around shaft 110 using conventional fasteners, and then the complete lower support collar 134 can be attached to an end of lower support 132 opposite vessel 10. This structure provides lower support for shaft 110, especially useful when propeller 39 is turning at full power.

FIG. 23 is a rear quarter elevated isometric view of an alternate embodiment steering clamp 120 with a steering clamp actuator 144 mechanically connected between its two halves. The two halves of steering clamp 120 depicted in FIG. 23 are connected at one side with steering clamp fastener 146, and at the other side by means of steering clamp actuator 144. Steering clamp actuator 144 is a bi-directional actuator, that is, it can both extend and retract. When steering clamp actuator 144 is extended, it separates the two halves of steering clamp 120, thus loosening it around shaft 110, and permitting shaft 110 to retract or extend relative to tube 112. After shaft 110 is in the desired position relative to tube 112, steering clamp actuator 144 is retracted, thus tightening steering clamp 120 around shaft 110 and immobilizing shaft 110 relative to steering clamp 120. The embodiment steering clamp 120 depicted in FIG. 23 avoids the necessity of manually loosening and re-tightening steering clamp 120 when it is desired to extend or retract shaft 110 relative to tube 112.

FIG. 24 is a rear quarter elevated isometric view of hydraulic thruster 20 incorporating two lower units 38 steered by steering actuator 180. Steering actuator 180 is a bi-directional actuator attached at one end to lower unit housing 42, and at an opposite end to tie rod 54. Because tie rod 54 is attached to, and steers, both lower units 38, retraction and extension of steering actuator 180 has the effect of rotating shafts 110 equally, thereby providing a steering function to hydraulic thruster 20. In the preferred embodiment, each steering clamp 120 incorporated a steering clamp bellcrank 182 which acted as a lever arm used to rotate the shaft 110 to which the steering clamp 120 was attached. One end of tie rod 54 was rotatably attached to each steering clamp bellcrank 182 at an end of steering clamp bellcrank 182 opposite the end of the steering clamp bellcrank 182 attached to steering clamp 120.

FIG. 25 is a rear quarter elevated isometric view of tilted-up lower unit housing 42 incorporating locking probe 152 rigidly mounted to locking probe tab 150 at an angle substantially perpendicular to locking probe tab 150. Locking probe tab is mounted to lower unit housing 42 at an angle substantially perpendicular to tube 112 and shaft 110. Locking probe 152 incorporates locking probe bore 154 at an end of locking probe 152 opposite locking probe tab 150.

Docking tab 156 is rigidly attached to base 30 in an orientation substantially co-planar with the plane of base 30. Docking tab 156 incorporates docking tab bore 158 disposed in a location wherein locking probe 152 slides into docking tab bore 158 when lower unit 38 is tilted into the down position, as indicated by arrow 166 in FIG. 25. Docking tab bore 158 is sized to slidably admit locking probe 152.

Docking probe 152 is sufficiently long so as to extend through docking tab bore 158 sufficiently to expose locking probe bore 154, the situation depicted in FIG. 26. FIG. 26 is a rear quarter elevated isometric view of a lower unit housing 42 incorporating locking probe 152 and docking tab bore 158 which has been fully tilted down as indicated by arrow 168, ready for pin 160 to be inserted into locking probe bore 154.

Locking probe bore 154 is sized to slidably admit pin 160. After pin 160 has been slid through locking probe bore 154 as indicated by arrow 170, safety element 164 may be slid through pin bore 162 in pin 160 as indicated by arrow 172, thus securely holding pin 160 in locking probe bore 154. Pin 160 through locking probe bore 154 in turn holds locking probe 152 securely within docking tab bore 158, which in turn locks lower unit 38 in the down-tilted position.

When it is desired to tilt lower unit 38 into the up position, safety element 164 is removed from pin 160, and pin 160 is slid out of locking probe bore 154, thus releasing lower unit 38 to tilt upwards. In the preferred embodiment, safety element 164 was a cotter pin, bolt and nut, spring retainer pin, or any other appropriate safety element.

In the preferred embodiment, base 30, helm platform 26, helm 24, hydraulic fluid reservoir 28, base feet 32, lower unit mounting tube supports 40, lower unit housing(s) 42, steering gear 52, locking probe 152, locking probe tab 150, docking tab 156, shaft 110, tube 112, tube lip 115, lower support 132, lower support collar 134, steering clamp 120, steering clamp bellcrank 148, and shaft clamps 116 were made using metal, synthetic, corrosion resistant metal, corrosion resistant metal fasteners, welded construction, or other appropriate materials.

Base 30 structural members such as base side spars 33, base rear spar 34, base foot 32, and lower unit mounting tube support(s) 40 may be plates, C beams, I beams, or any other appropriate structural member shape. Steering motor 56, overhung load adaptor 58, drive gear 60, steering gear 52, and hydraulic power pack 22 were commercially available items.

In the preferred embodiment, tilt actuator 88, lower unit actuator 102, steering actuator 146, and steering clamp actuator 144 were hydraulic actuators powered by pressurized hydraulic fluid from hydraulic power pack 22, and controlled from helm 24, although it is intended to fall within the scope of this disclosure that these elements be any appropriate actuator, including but not limited to electrical actuators, solenoids, linear motors, rack-and-pinion gear arrangements, etc. In the preferred embodiment these elements were connected to hydraulic power pack 22 by any appropriate means, including hydraulic lines, which along with wiring, controls, and other existent elements well-known in the art are not shown in the figures in interest of clarity.

Lower unit bushings 46, tube bushings 130, and lower support collar insert 136 were made of ultra-high density polyethylene, nylon, plastic, synthetic, teflon, felt or other appropriate material.

While a preferred embodiment of the invention has been illustrated herein, it is to be understood that changes and variations may be made by those skilled in the art without departing from the spirit of the appending claims.

DRAWING ITEM INDEX

2 prior art marine thruster
4 prior art marine thruster lower unit
10 vessel
12 lower unit bore
14 mounting tube bore
16 arrow
18 arrow
20 hydraulic thruster
22 hydraulic power pack
24 helm
26 helm platform
28 hydraulic fluid reservoir
30 base
32 base foot
33 base side spar
34 base rear spar
36 lower unit mounting tube
38 lower unit
39 propeller
40 lower unit mounting tube support
42 lower unit housing
44 vessel stop
46 lower unit bushing
47 lower unit bushing bore
48 lower unit bushing lesser outside diameter
49 lower unit bushing greater outside diameter
50 steering assembly
52 steering gear
54 tie rod
56 steering motor
58 overhung load adaptor
60 drive gear
62 lower unit housing roof
63 lower unit housing wall
64 lower unit housing floor
65 lower unit housing roof bore
66 lower unit housing wall bore
67 lower unit housing floor bore
68 arrow
69 arrow
70 arrow
72 arrow
74 arrow
76 arrow
78 arrow
80 base foot rear spar
82 base foot side spar
84 base foot center spar
86 base foot reinforcement plate
88 tilt actuator
90 arrow
92 arrow
94 arrow
102 lower unit actuator
104 arrow
106 arrow
107 arrow
110 shaft
112 tube
113 tube bore
114 actuator collar
115 shaft lip
116 shaft clamp
118 arrow
120 steering clamp
121 steering clamp aperture
122 steering clamp key
124 shaft keyway
130 tube bushing
132 lower support
134 lower support collar
135 lower support collar aperture
136 lower support collar insert
137 lower support collar inner face groove
138 shaft key
139 lower support collar inner face
140 steering clamp keyway
142 lower support collar insert aperture
144 steering clamp actuator
146 steering clamp fastener
150 locking probe tab
152 locking probe
154 locking probe bore
156 docking tab
158 docking tab bore
160 pin
162 pin bore
164 safety element
166 arrow
168 arrow
170 arrow
172 arrow
180 steering actuator
182 steering clamp bellcrank

I claim:

1. A hydraulic thruster comprising a lower unit mounting tube mounted at an aft end of a base, at least one lower unit tiltably attached to said lower unit mounting tube, each said lower unit comprising a lower unit housing tiltably attached to said lower unit mounting tube, a tube attached through said lower unit housing at an angle substantially perpendicular to said lower unit mounting tube, a shaft slidably disposed within said tube, an upper end of said tube being attached to said lower unit housing, a substantial length of said tube extending downwards from said lower unit housing whereby said tube reinforces said shaft, and a steering clamp releasably attached to an end of said shaft protruding above said lower unit housing.

2. The hydraulic thruster of claim 1 wherein said steering clamp comprises a steering clamp aperture sized to releasably admit said shaft, and said shaft further comprises a shaft lip at an end of said shaft protruding through an end of said tube which is attached to said lower unit housing, a major dimension of said shaft lip exceeding a diameter of said steering clamp aperture, whereby said shaft lip acts as a stop to prevent an upper end of said shaft from slipping down into said tube.

3. The hydraulic thruster of claim 2 wherein said shaft further comprises a shaft key extending radially outwards from an upper end of said shaft adjacent said shaft lip, and wherein said steering clamp further comprises a steering clamp keyway sized to slidably admit said shaft key, said shaft key being disposed within said steering clamp keyway when said shaft is fully extended relative to said tube, whereby said shaft is prevented from rotating relative to said steering clamp when said shaft key is disposed within said steering clamp keyway.

4. The hydraulic thruster of claim 3 further comprising a steering gear rigidly attached to said steering clamp, and a steering assembly driving said steering clamp, whereby a steering function is provided to said shaft.

5. The hydraulic thruster of claim 1 further comprising a lower unit actuator, one end of said lower unit actuator being attached to said tube, another end of said lower unit actuator being attached to said shaft, whereby extension and retraction of said lower unit actuator has the effect of extending and retracting said shaft relative to said tube.

6. The hydraulic thruster of claim 5 whereby said lower unit actuator is attached to said shaft by means of an actuator collar rotatably attached to said shaft.

7. The hydraulic thruster of claim of claim 6 further comprising a shaft clamp attached around said shaft at either end of said actuator collar, whereby said shaft clamps prevent said actuator collar from moving axially along said shaft, sufficient clearance being provided between each said shaft clamp and said actuator collar to avoid any substantial friction between said shaft clamps and said actuator collar.

8. The hydraulic thruster of claim 7 wherein said lower unit actuator is a hydraulic actuator.

9. The hydraulic thruster of claim 5 wherein said shaft comprises an axially disposed shaft keyway along an upper outside surface of said shaft, and wherein said steering clamp further comprises a steering clamp key extending radially into said steering clamp aperture, said shaft keyway being sized to slidably admit said steering clamp key, said steering clamp key being disposed within said shaft keyway.

10. The hydraulic thruster of claim 9 further comprising a steering gear rigidly attached to said steering clamp, and a steering assembly driving said steering clamp, whereby a steering function is provided to said shaft.

11. The hydraulic thruster of claim 1 wherein said steering clamp is a split-ring clamp comprising two halves, one end of said halves being mutually attached by means of at least one steering clamp fastener, another end of said halves being mutually and separably attached by means of a steering clamp actuator, one end of said steering clamp actuator being mechanically attached to one end of one said clamp half, an opposite end of said steering clamp actuator being mechanically attached to a corresponding end of the other said clamp half.

12. The hydraulic thruster of claim 11 wherein said steering clamp actuator is a hydraulic actuator.

13. A hydraulic thruster comprising a lower unit mounting tube mounted at an aft end of a base, at least one lower unit tiltably attached to said lower unit mounting tube, each said lower unit comprising a lower unit housing tiltably attached to said lower unit mounting tube, a tube attached through said lower unit housing at an angle substantially perpendicular to said lower unit mounting tube, a shaft slidably disposed within said tube, an upper end of said tube being attached to said lower unit housing, a substantial length of said tube extending downwards from said lower unit housing whereby said tube reinforces said shaft, and a lower support rigidly attached to a lower support collar, said lower support collar being slidably and rotatably attached to said shaft.

14. The hydraulic thruster of claim 13 wherein said lower support collar further comprises a lower support collar aperture, a lower support collar inner face bounding said lower support collar aperture, a lower support collar inner face groove circumferentially disposed around said lower support collar inner face, a lower support collar insert disposed within said lower support collar inner face groove, and a lower support collar insert aperture in said lower support collar insert, said lower support collar insert aperture being sized to slidably and rotatably admit said shaft.

15. The hydraulic thruster of claim 14 further comprising a vessel to which said hydraulic thruster is attached, an end of said lower support being rigidly attached to said vessel.

16. A hydraulic thruster comprising a lower unit mounting tube mounted at an aft end of a base, two lower units tiltably attached to said lower unit mounting tube, each said lower unit comprising a lower unit housing tiltably attached to said lower unit mounting tube, a tube attached through each said lower unit housing at an angle substantially perpendicular to said lower unit mounting tube, a shaft slidably disposed within each said tube, an upper end of each said tube being attached to said lower unit housing, a substantial length of each said tube extending downwards from a corresponding said lower unit housing whereby said tube reinforces said shaft, a tie rod rotatably attached at one end to a shaft corresponding to one said lower unit and at an opposite end to a shaft corresponding to the other said lower unit, and a steering actuator attached at one end to said tie rod and at an opposite end to one said lower unit housing, whereby extension and retraction of said steering actuator rotates each said shaft through an equal angle, thereby providing a steering function to both said shafts.

17. The hydraulic thruster of claim 16 wherein each said lower unit further comprises a steering clamp releasably attached to an end of said shaft protruding through an end of said tube which is attached to a corresponding said lower unit housing, an end of said tie rod being rotatably attached to each said steering clamp.

18. The hydraulic thruster of claim 17 wherein each said steering clamp comprises a steering clamp bellcrank rigidly attached to said steering clamp and extending radially outwards from said steering clamp, each end of said tie rod being rotatably attached to an end of a respective said bellcrank opposite said shaft.

19. The hydraulic thruster of claim 18 wherein said steering actuator is hydraulic.

20. A hydraulic thruster comprising a lower unit mounting tube mounted at an aft end of a base, at least one lower unit tiltably attached to said lower unit mounting tube, each said lower unit comprising a lower unit housing tiltably attached to said lower unit mounting tube, a tube attached through said lower unit housing at an angle substantially perpendicular to said lower unit mounting tube, a shaft slidably disposed within said tube, an upper end of said tube being attached to said lower unit housing, a substantial length of said tube extending downwards from said lower unit housing whereby said tube reinforces said shaft a locking probe tab rigidly attached to said lower unit housing, a plane of said locking tab being substantially perpendicular to said shaft, a locking probe attached to said locking probe tab at an orientation substantially perpendicular to said locking probe tab, a docking tab attached to said base, a plane of said docking tab being substantially parallel to a plane of said base, and a docking tab bore in said docking tab sized to admit said locking probe, whereby when said lower unit is tilted downwards, said locking probe slides into said docking tab bore.

21. The hydraulic thruster of claim 20 further comprising a safety element, a pin having a pin bore sized to admit said safety element, and a locking probe bore sized to admit said pin in said locking probe, whereby after said lower unit is tilted downwards, thereby sliding said locking probe through said docking tab bore, said pin may be inserted through said locking probe bore, and said safety element through said pin bore, thereby locking said lower unit in a down-tilted position.

22. A hydraulic thruster comprising a lower unit mounting tube mounted at an aft end of a base, at least one lower unit comprising a lower unit housing tiltably attached to said lower unit mounting tube, a tube attached through said lower unit housing at an angle substantially perpendicular to said lower unit mounting tube, an upper end of said tube being attached to said lower unit housing, a substantial length of said tube extending downwards from said lower unit housing, a shaft slidably disposed within said tube, and a steering clamp releasably attached to an end of said shaft extending upwards through said tube.

23. The hydraulic thruster of claim 22 wherein a ratio of a length of said tube to a length of said shaft is between 0.24 and 0.32.

24. The hydraulic thruster of claim 22 further comprising a tube bore in said tube, and a tube bushing at each end of said tube bore, each said tube bushing being sized to slidably admit said shaft, whereby said shaft is slidably mounted within said tube on said tube bushings.

25. The hydraulic thruster of claim 22 wherein said steering clamp is a split-ring clamp comprising two halves, one end of said halves being mutually attached by means of at least one steering clamp fastener, another end of said halves being mutually and separably attached by means of a steering clamp actuator, one end of said steering clamp actuator being mechanically attached to one end of one said clamp half, an opposite end of said steering clamp actuator being mechanically attached to a corresponding end of the other said clamp half.

26. The hydraulic thruster of claim 22 wherein said shaft comprises an axially disposed shaft keyway along an upper outside surface of said shaft, and wherein said steering clamp further comprises a steering clamp key extending radially into a steering clamp aperture, said shaft keyway being sized to slidably admit said steering clamp key, said steering clamp key being disposed within, and traveling in, said shaft keyway.

27. The hydraulic thruster of claim 26 further comprising a lower unit actuator, one end of said lower unit actuator being attached to said tube, another end of said lower unit actuator being rotatably attached to said shaft, whereby extension and retraction of said lower unit actuator has the effect of extending and retracting said shaft relative to said tube.

28. The hydraulic thruster of claim 22 wherein said shaft further comprises a shaft key extending radially outwards from an upper end of said shaft, and wherein said steering clamp further comprises a steering clamp keyway sized to slidably admit said shaft key, said shaft key being disposed within said steering clamp keyway when said shaft is fully extended relative to said tube, whereby said shaft is prevented from rotating relative to said steering clamp when said shaft key is disposed within said steering clamp keyway.

29. The hydraulic thruster of claim 22 further comprising a helm platform mounted on said base, at least one end of said lower unit mounting tube extending laterally beyond said helm platform by an amount at least equal to a width of said lower unit, whereby when said lower unit is retracted and tilted up, said lower unit is disposed along one side of said helm platform, and said helm platform does not interfere with retraction, extension, tilting up, or tilting down of said lower unit.

* * * * *